US008049713B2

(12) United States Patent
Sampsell

(10) Patent No.: US 8,049,713 B2
(45) Date of Patent: Nov. 1, 2011

(54) POWER CONSUMPTION OPTIMIZED DISPLAY UPDATE

(75) Inventor: Jeffrey Brian Sampsell, San Jose, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 316 days.

(21) Appl. No.: 11/409,677

(22) Filed: Apr. 24, 2006

(65) Prior Publication Data

US 2007/0247419 A1 Oct. 25, 2007

(51) Int. Cl.
*G09G 3/34* (2006.01)

(52) U.S. Cl. ..... 345/108

(58) Field of Classification Search ..... 345/32–33, 345/84–86, 100, 103, 108–111; 359/237–238, 359/242, 260, 288, 290–291
See application file for complete search history.

(56) References Cited

U.S. PATENT DOCUMENTS

| | | | |
|---|---|---|---|
| 3,982,239 | A | 9/1976 | Sherr |
| 4,403,248 | A | 9/1983 | te Velde |
| 4,441,791 | A | 4/1984 | Hornbeck |
| 4,459,182 | A | 7/1984 | te Velde |
| 4,482,213 | A | 11/1984 | Piliavin et al. |
| 4,500,171 | A | 2/1985 | Penz et al. |
| 4,519,676 | A | 5/1985 | te Velde |
| 4,566,935 | A | 1/1986 | Hornbeck |
| 4,571,603 | A | 2/1986 | Hornbeck et al. |
| 4,596,992 | A | 6/1986 | Hornbeck |
| 4,615,595 | A | 10/1986 | Hornbeck |
| 4,662,746 | A | 5/1987 | Hornbeck |
| 4,681,403 | A | 7/1987 | te Velde et al. |
| 4,709,995 | A | 12/1987 | Kuribayashi et al. |
| 4,710,732 | A | 12/1987 | Hornbeck |
| 4,856,863 | A | 8/1989 | Sampsell et al. |
| 4,859,060 | A | 8/1989 | Katagiri et al. |
| 4,954,789 | A | 9/1990 | Sampsell |
| 4,956,619 | A | 9/1990 | Hornbeck |
| 4,982,184 | A | 1/1991 | Kirkwood |
| 5,018,256 | A | 5/1991 | Hornbeck |
| 5,028,939 | A | 7/1991 | Hornbeck et al. |
| 5,037,173 | A | 8/1991 | Sampsell et al. |

(Continued)

FOREIGN PATENT DOCUMENTS

| | | | |
|---|---|---|---|
| EP | 0295802 | A | 12/1988 |

(Continued)

OTHER PUBLICATIONS

ISR and WO for PCT/US07/009333, filed Apr. 17, 2007.

(Continued)

*Primary Examiner* — Sumati Lefkowitz
*Assistant Examiner* — Robert E Carter, III
(74) *Attorney, Agent, or Firm* — Knobbe Martens Olson & Bear, LLP

(57) ABSTRACT

Systems and methods for reducing the power consumption necessary for updating a display are provided. The methods include determining a row addressing order based on an attribute of the image data that minimizes the number of column charging transitions necessary to write the image data to the display. In some embodiments, the row-addressing order is determined based on a determination of a whiteness value for the row. In some embodiments, a power-optimized row-addressing order is embedded in image data, allowing a display device to write the image data to the display more efficiently.

36 Claims, 14 Drawing Sheets

U.S. PATENT DOCUMENTS

| | | | | |
|---|---|---|---|---|
| 5,055,833 | A | | 10/1991 | Hehlen et al. |
| 5,061,049 | A | | 10/1991 | Hornbeck |
| 5,078,479 | A | | 1/1992 | Vuilleumier |
| 5,079,544 | A | | 1/1992 | DeMond et al. |
| 5,083,857 | A | | 1/1992 | Hornbeck |
| 5,096,279 | A | | 3/1992 | Hornbeck et al. |
| 5,099,353 | A | | 3/1992 | Hornbeck |
| 5,124,834 | A | | 6/1992 | Cusano et al. |
| 5,142,405 | A | | 8/1992 | Hornbeck |
| 5,142,414 | A | | 8/1992 | Koehler et al. |
| 5,162,787 | A | | 11/1992 | Thompson et al. |
| 5,168,406 | A | | 12/1992 | Nelson |
| 5,170,156 | A | | 12/1992 | DeMond et al. |
| 5,172,262 | A | | 12/1992 | Hornbeck |
| 5,179,274 | A | | 1/1993 | Sampsell |
| 5,192,395 | A | | 3/1993 | Boysel et al. |
| 5,192,946 | A | | 3/1993 | Thompson et al. |
| 5,206,629 | A | | 4/1993 | DeMond et al. |
| 5,212,582 | A | | 5/1993 | Nelson |
| 5,214,419 | A | | 5/1993 | DeMond et al. |
| 5,214,420 | A | | 5/1993 | Thompson et al. |
| 5,216,537 | A | | 6/1993 | Hornbeck |
| 5,226,099 | A | | 7/1993 | Mignardi et al. |
| 5,227,900 | A | | 7/1993 | Inaba et al. |
| 5,231,532 | A | | 7/1993 | Magel et al. |
| 5,233,385 | A | | 8/1993 | Sampsell |
| 5,233,456 | A | | 8/1993 | Nelson |
| 5,233,459 | A | | 8/1993 | Bozler et al. |
| 5,254,980 | A | | 10/1993 | Hendrix et al. |
| 5,272,473 | A | | 12/1993 | Thompson et al. |
| 5,278,652 | A | | 1/1994 | Urbanus et al. |
| 5,280,277 | A | | 1/1994 | Hornbeck |
| 5,285,196 | A | | 2/1994 | Gale, Jr. |
| 5,287,096 | A | | 2/1994 | Thompson et al. |
| 5,287,215 | A | | 2/1994 | Warde et al. |
| 5,296,950 | A | | 3/1994 | Lin et al. |
| 5,305,640 | A | | 4/1994 | Boysel et al. |
| 5,312,513 | A | | 5/1994 | Florence et al. |
| 5,323,002 | A | | 6/1994 | Sampsell et al. |
| 5,325,116 | A | | 6/1994 | Sampsell |
| 5,327,286 | A | | 7/1994 | Sampsell et al. |
| 5,331,454 | A | | 7/1994 | Hornbeck |
| 5,339,116 | A | | 8/1994 | Urbanus et al. |
| 5,365,283 | A | | 11/1994 | Doherty et al. |
| 5,411,769 | A | | 5/1995 | Hornbeck |
| 5,418,548 | A | * | 5/1995 | Fukushi ..... 715/856 |
| 5,444,566 | A | | 8/1995 | Gale et al. |
| 5,446,479 | A | | 8/1995 | Thompson et al. |
| 5,448,314 | A | | 9/1995 | Heimbuch et al. |
| 5,452,024 | A | | 9/1995 | Sampsell |
| 5,454,906 | A | | 10/1995 | Baker et al. |
| 5,457,493 | A | | 10/1995 | Leddy et al. |
| 5,457,566 | A | | 10/1995 | Sampsell et al. |
| 5,459,602 | A | | 10/1995 | Sampsell |
| 5,461,411 | A | | 10/1995 | Florence et al. |
| 5,481,274 | A | * | 1/1996 | Aratani et al. ..... 345/98 |
| 5,488,505 | A | | 1/1996 | Engle |
| 5,489,952 | A | | 2/1996 | Gove et al. |
| 5,497,172 | A | | 3/1996 | Doherty et al. |
| 5,497,197 | A | | 3/1996 | Gove et al. |
| 5,499,062 | A | | 3/1996 | Urbanus |
| 5,506,597 | A | | 4/1996 | Thompson et al. |
| 5,515,076 | A | | 5/1996 | Thompson et al. |
| 5,517,347 | A | | 5/1996 | Sampsell |
| 5,523,803 | A | | 6/1996 | Urbanus et al. |
| 5,526,051 | A | | 6/1996 | Gove et al. |
| 5,526,172 | A | | 6/1996 | Kanack |
| 5,526,688 | A | | 6/1996 | Boysel et al. |
| 5,535,047 | A | | 7/1996 | Hornbeck |
| 5,548,301 | A | | 8/1996 | Kornher et al. |
| 5,551,293 | A | | 9/1996 | Boysel et al. |
| 5,552,924 | A | | 9/1996 | Tregilgas |
| 5,552,925 | A | | 9/1996 | Worley |
| 5,563,398 | A | | 10/1996 | Sampsell |
| 5,567,334 | A | | 10/1996 | Baker et al. |
| 5,570,135 | A | | 10/1996 | Gove et al. |
| 5,578,976 | A | | 11/1996 | Yao |
| 5,581,272 | A | | 12/1996 | Conner et al. |
| 5,583,688 | A | | 12/1996 | Hornbeck |
| 5,589,852 | A | | 12/1996 | Thompson et al. |
| 5,597,736 | A | | 1/1997 | Sampsell |
| 5,598,565 | A | | 1/1997 | Reinhardt |
| 5,600,383 | A | | 2/1997 | Hornbeck |
| 5,602,671 | A | | 2/1997 | Hornbeck |
| 5,606,441 | A | | 2/1997 | Florence et al. |
| 5,608,468 | A | | 3/1997 | Gove et al. |
| 5,610,438 | A | | 3/1997 | Wallace et al. |
| 5,610,624 | A | | 3/1997 | Bhuva |
| 5,610,625 | A | | 3/1997 | Sampsell |
| 5,612,713 | A | | 3/1997 | Bhuva et al. |
| 5,619,061 | A | | 4/1997 | Goldsmith et al. |
| 5,619,365 | A | | 4/1997 | Rhoads et al. |
| 5,619,366 | A | | 4/1997 | Rhoads et al. |
| 5,629,790 | A | | 5/1997 | Neukermans et al. |
| 5,633,652 | A | | 5/1997 | Kanbe et al. |
| 5,636,052 | A | | 6/1997 | Arney et al. |
| 5,638,084 | A | | 6/1997 | Kalt |
| 5,638,946 | A | | 6/1997 | Zavracky et al. |
| 5,646,768 | A | | 7/1997 | Kaeiyama |
| 5,650,881 | A | | 7/1997 | Hornbeck |
| 5,654,741 | A | | 8/1997 | Sampsell et al. |
| 5,657,099 | A | | 8/1997 | Doherty et al. |
| 5,659,374 | A | | 8/1997 | Gale, Jr. et al. |
| 5,665,997 | A | | 9/1997 | Weaver et al. |
| 5,699,075 | A | | 12/1997 | Miyamoto |
| 5,745,193 | A | | 4/1998 | Urbanus et al. |
| 5,745,281 | A | | 4/1998 | Yi et al. |
| 5,754,160 | A | | 5/1998 | Shimizu et al. |
| 5,771,116 | A | | 6/1998 | Miller et al. |
| 5,784,189 | A | | 7/1998 | Bozler et al. |
| 5,784,212 | A | | 7/1998 | Hornbeck |
| 5,790,548 | A | * | 8/1998 | Sistanizadeh et al. ..... 370/401 |
| 5,808,780 | A | | 9/1998 | McDonald |
| 5,818,095 | A | | 10/1998 | Sampsell |
| 5,828,367 | A | | 10/1998 | Kuga |
| 5,835,255 | A | | 11/1998 | Miles |
| 5,842,088 | A | | 11/1998 | Thompson |
| 5,867,302 | A | | 2/1999 | Fleming et al. |
| 5,912,758 | A | | 6/1999 | Knipe et al. |
| 5,943,158 | A | | 8/1999 | Ford et al. |
| 5,959,763 | A | | 9/1999 | Bozler et al. |
| 5,966,235 | A | | 10/1999 | Walker et al. |
| 5,986,796 | A | | 11/1999 | Miles |
| 6,028,690 | A | | 2/2000 | Carter et al. |
| 6,038,056 | A | | 3/2000 | Florence et al. |
| 6,040,937 | A | | 3/2000 | Miles |
| 6,049,317 | A | | 4/2000 | Thompson et al. |
| 6,055,090 | A | | 4/2000 | Miles |
| 6,061,075 | A | | 5/2000 | Nelson et al. |
| 6,099,132 | A | | 8/2000 | Kaeriyama |
| 6,100,872 | A | | 8/2000 | Aratani et al. |
| 6,113,239 | A | | 9/2000 | Sampsell et al. |
| 6,147,790 | A | | 11/2000 | Meier et al. |
| 6,160,833 | A | | 12/2000 | Floyd et al. |
| 6,180,428 | B1 | | 1/2001 | Peeters et al. |
| 6,201,633 | B1 | | 3/2001 | Peeters et al. |
| 6,232,936 | B1 | | 5/2001 | Gove et al. |
| 6,275,326 | B1 | | 8/2001 | Bhalla et al. |
| 6,282,010 | B1 | | 8/2001 | Sulzbach et al. |
| 6,295,154 | B1 | | 9/2001 | Laor et al. |
| 6,300,922 | B1 | | 10/2001 | Teggatz |
| 6,304,297 | B1 | | 10/2001 | Swan |
| 6,323,982 | B1 | | 11/2001 | Hornbeck |
| 6,327,071 | B1 | | 12/2001 | Kimura |
| 6,356,085 | B1 | | 3/2002 | Ryat et al. |
| 6,356,254 | B1 | | 3/2002 | Kimura |
| 6,429,601 | B1 | | 8/2002 | Friend et al. |
| 6,433,917 | B1 | | 8/2002 | Mei et al. |
| 6,447,126 | B1 | | 9/2002 | Hornbeck |
| 6,465,355 | B1 | | 10/2002 | Horsley |
| 6,466,358 | B2 | | 10/2002 | Tew |
| 6,473,274 | B1 | | 10/2002 | Maimone et al. |
| 6,480,177 | B2 | | 11/2002 | Doherty et al. |
| 6,496,122 | B2 | | 12/2002 | Sampsell |
| 6,501,107 | B1 | | 12/2002 | Sinclair et al. |
| 6,507,330 | B1 | | 1/2003 | Handschy et al. |
| 6,507,331 | B1 | | 1/2003 | Schlangen et al. |

6,545,335 B1 4/2003 Chua et al.
6,548,908 B2 4/2003 Chua et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,593,934 B1 7/2003 Liaw et al.
6,600,201 B2 7/2003 Hartwell et al.
6,606,175 B1 8/2003 Sampsell et al.
6,625,047 B2 9/2003 Coleman, Jr.
6,630,786 B2 10/2003 Cummings et al.
6,632,698 B2 10/2003 Ives
6,636,187 B2 * 10/2003 Tajima et al. ..... 345/55
6,643,069 B2 11/2003 Dewald
6,650,455 B2 11/2003 Miles
6,666,561 B1 12/2003 Blakley
6,674,090 B1 1/2004 Chua et al.
6,674,562 B1 1/2004 Miles
6,680,792 B2 1/2004 Miles
6,710,908 B2 3/2004 Miles et al.
6,741,377 B2 5/2004 Miles
6,741,384 B1 5/2004 Martin et al.
6,741,503 B1 5/2004 Farris et al.
6,747,785 B2 6/2004 Chen et al.
6,750,876 B1 * 6/2004 Atsatt et al. ..... 345/656
6,762,873 B1 7/2004 Coker et al.
6,775,174 B2 8/2004 Huffman et al.
6,778,155 B2 8/2004 Doherty et al.
6,781,643 B1 8/2004 Watanabe et al.
6,787,384 B2 9/2004 Okumura
6,787,438 B1 9/2004 Nelson
6,788,520 B1 9/2004 Behin et al.
6,794,119 B2 9/2004 Miles
6,811,267 B1 11/2004 Allen et al.
6,813,060 B1 11/2004 Garcia et al.
6,819,469 B1 11/2004 Koba
6,822,628 B2 11/2004 Dunphy et al.
6,829,132 B2 12/2004 Martin et al.
6,853,129 B1 2/2005 Cummings et al.
6,855,610 B2 2/2005 Tung et al.
6,859,218 B1 2/2005 Luman et al.
6,861,277 B1 3/2005 Monroe et al.
6,862,022 B2 3/2005 Slupe
6,862,029 B1 3/2005 D'Souza et al.
6,867,896 B2 3/2005 Miles
6,870,581 B2 3/2005 Li et al.
6,903,860 B2 6/2005 Ishii
7,034,783 B2 4/2006 Gates et al.
7,123,216 B1 10/2006 Miles
7,161,728 B2 1/2007 Sampsell et al.
7,400,489 B2 7/2008 Van Brocklin et al.
2001/0003487 A1 6/2001 Miles
2001/0026250 A1 10/2001 Inoue et al.
2001/0034075 A1 10/2001 Onoya
2001/0040536 A1 11/2001 Tajima et al.
2001/0043171 A1 11/2001 Van Gorkom et al.
2001/0046081 A1 11/2001 Hayashi et al.
2001/0051014 A1 12/2001 Behin et al.
2001/0052887 A1 12/2001 Tsutsui et al.
2002/0000959 A1 1/2002 Colgan et al.
2002/0005827 A1 1/2002 Kobayashi
2002/0012159 A1 1/2002 Tew
2002/0015215 A1 2/2002 Miles
2002/0024711 A1 2/2002 Miles
2002/0036304 A1 3/2002 Ehmke et al.
2002/0050882 A1 5/2002 Hyman et al.
2002/0054424 A1 5/2002 Miles
2002/0075226 A1 6/2002 Lippincott
2002/0075555 A1 6/2002 Miles
2002/0093722 A1 7/2002 Chan et al.
2002/0097133 A1 7/2002 Charvet et al.
2002/0105950 A1 * 8/2002 Dapper et al. ..... 370/386
2002/0126364 A1 9/2002 Miles
2002/0179421 A1 12/2002 Williams et al.
2002/0186108 A1 12/2002 Hallbjorner
2003/0004272 A1 1/2003 Power
2003/0020699 A1 1/2003 Nakatani et al.
2003/0043157 A1 3/2003 Miles
2003/0072070 A1 4/2003 Miles
2003/0122773 A1 7/2003 Washio et al.
2003/0137215 A1 7/2003 Cabuz
2003/0137521 A1 7/2003 Zehner et al.
2003/0189536 A1 10/2003 Ruigt
2003/0202264 A1 10/2003 Weber et al.
2003/0202265 A1 10/2003 Reboa et al.
2003/0202266 A1 10/2003 Ring et al.
2004/0008396 A1 1/2004 Stappaerts
2004/0021658 A1 2/2004 Chen
2004/0022044 A1 2/2004 Yasuoka et al.
2004/0027701 A1 2/2004 Ishikawa
2004/0051929 A1 3/2004 Sampsell et al.
2004/0058532 A1 3/2004 Miles et al.
2004/0080807 A1 4/2004 Chen et al.
2004/0125110 A1 * 7/2004 Kohda et al. ..... 345/501
2004/0136596 A1 7/2004 Oneda et al.
2004/0145049 A1 7/2004 McKinnell et al.
2004/0145553 A1 * 7/2004 Sala et al. ..... 345/87
2004/0147056 A1 7/2004 McKinnell et al.
2004/0160143 A1 8/2004 Shreeve et al.
2004/0174583 A1 9/2004 Chen et al.
2004/0179281 A1 9/2004 Reboa
2004/0212026 A1 10/2004 Van Brocklin et al.
2004/0217378 A1 11/2004 Martin et al.
2004/0217919 A1 11/2004 Pichl et al.
2004/0218251 A1 11/2004 Piehl et al.
2004/0218334 A1 11/2004 Martin et al.
2004/0218341 A1 11/2004 Martin et al.
2004/0223204 A1 11/2004 Mao et al.
2004/0227493 A1 11/2004 Van Brocklin et al.
2004/0240032 A1 12/2004 Miles
2004/0240138 A1 12/2004 Martin et al.
2004/0245588 A1 12/2004 Nikkel et al.
2004/0263944 A1 12/2004 Miles et al.
2005/0001828 A1 1/2005 Martin et al.
2005/0012577 A1 1/2005 Pillans et al.
2005/0024301 A1 2/2005 Funston
2005/0038950 A1 2/2005 Adelmann
2005/0046922 A1 * 3/2005 Lin et al. ..... 359/291
2005/0057442 A1 3/2005 Way
2005/0068583 A1 3/2005 Gutkowski et al.
2005/0069209 A1 3/2005 Damera-Venkata et al.
2005/0116924 A1 6/2005 Sauvante et al.
2005/0185003 A1 * 8/2005 Dedene et al. ..... 345/694
2005/0206991 A1 9/2005 Chui et al.
2005/0286113 A1 12/2005 Miles
2005/0286114 A1 12/2005 Miles
2006/0044246 A1 3/2006 Mignard
2006/0044298 A1 3/2006 Mignard et al.
2006/0044928 A1 3/2006 Chui et al.
2006/0056000 A1 3/2006 Mignard
2006/0057754 A1 3/2006 Cummings
2006/0066542 A1 3/2006 Chui
2006/0066559 A1 3/2006 Chui et al.
2006/0066560 A1 3/2006 Gally et al.
2006/0066561 A1 3/2006 Chui et al.
2006/0066594 A1 3/2006 Tyger
2006/0066597 A1 3/2006 Sampsell
2006/0066598 A1 3/2006 Floyd
2006/0066601 A1 3/2006 Kothari
2006/0066935 A1 3/2006 Cummings et al.
2006/0066937 A1 3/2006 Chui
2006/0066938 A1 3/2006 Chui
2006/0067648 A1 3/2006 Chui et al.
2006/0067653 A1 3/2006 Gally et al.
2006/0077127 A1 4/2006 Sampsell et al.
2006/0077505 A1 4/2006 Chui et al.
2006/0077520 A1 4/2006 Chui et al.
2006/0103613 A1 5/2006 Chui
2006/0250335 A1 11/2006 Stewart et al.
2006/0250350 A1 11/2006 Kothari et al.
2006/0294573 A1 * 12/2006 Rogers et al. ..... 725/147
2007/0126673 A1 6/2007 Djordjev et al.
2007/0147688 A1 6/2007 Mathew
2009/0219309 A1 9/2009 Sampsell
2009/0219600 A1 9/2009 Gally et al.
2009/0225069 A1 9/2009 Sampsell

| | | | |
|---|---|---|---|
| 2009/0273596 | A1 | 11/2009 | Cummings |
| 2010/0026680 | A1 | 2/2010 | Chui et al. |
| 2010/0315398 | A1 | 12/2010 | Chui et al. |

FOREIGN PATENT DOCUMENTS

| | | | |
|---|---|---|---|
| EP | 0300754 | A2 | 1/1989 |
| EP | 0306308 | A2 | 3/1989 |
| EP | 0318050 | A | 5/1989 |
| EP | 0 417 523 | A | 3/1991 |
| EP | 0 467 048 | A | 1/1992 |
| EP | 0570906 | A | 11/1993 |
| EP | 0608056 | A1 | 7/1994 |
| EP | 0655725 | A1 | 5/1995 |
| EP | 0667548 | A1 | 8/1995 |
| EP | 0725380 | A1 | 8/1996 |
| EP | 0852371 | A1 | 7/1998 |
| EP | 0911794 | A1 | 4/1999 |
| EP | 0 017 038 | A | 7/2000 |
| EP | 1 134 721 | | 9/2001 |
| EP | 1146533 | A | 10/2001 |
| EP | 1 239 448 | | 9/2002 |
| EP | 1 280 129 | | 1/2003 |
| EP | 1343190 | A | 9/2003 |
| EP | 1345197 | A | 9/2003 |
| EP | 1381023 | A | 1/2004 |
| EP | 1 414 011 | | 4/2004 |
| EP | 1473691 | A2 | 11/2004 |
| EP | 1 640 953 | | 3/2006 |
| GB | 2401200 | A | 11/2004 |
| JP | 07 064512 | | 3/1995 |
| JP | 2000-075963 | | 4/2000 |
| JP | 2004-29571 | | 1/2004 |
| WO | WO 95/30924 | | 11/1995 |
| WO | WO 97/17628 | | 5/1997 |
| WO | WO 99/52006 | A3 | 10/1999 |
| WO | WO 01/73937 | A | 10/2001 |
| WO | WO 01/82284 | | 11/2001 |
| WO | WO 02/089103 | | 11/2002 |
| WO | WO 03/007049 | A1 | 1/2003 |
| WO | WO 03/015071 | A2 | 2/2003 |
| WO | WO 03/044765 | A2 | 5/2003 |
| WO | WO 03/060940 | A | 7/2003 |
| WO | WO 03/069413 | A1 | 8/2003 |
| WO | WO 03/073151 | A1 | 9/2003 |
| WO | WO 03/079323 | A | 9/2003 |
| WO | WO 03/090199 | A1 | 10/2003 |
| WO | WO 2004/006003 | A1 | 1/2004 |
| WO | WO 2004/026757 | A | 4/2004 |
| WO | WO 2004/049034 | A1 | 6/2004 |
| WO | WO 2004/054088 | | 6/2004 |

OTHER PUBLICATIONS

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

Chen et al., Low peak current driving scheme for passive matrix-OLED, SID International Symposium Digest of Technical Papers, May 2003, pp. 504-507.

Bains, "Digital Paper Display Technology holds Promise for Portables", CommsDesign EE Times (2000).

Lieberman, "MEMS Display Looks to give PDAs Sharper Image" EE Times (2004).

Lieberman, "Microbridges at heart of new MEMS displays" EE Times (2004).

Peroulis et al., Low contact resistance series MEMS switches, 2002, pp. 223-226, vol. 1, IEEE MTT-S International Microwave Symposium Digest, New York, NY.

Seeger et al., "Stabilization of Electrostatically Actuated Mechanical Devices", (1997) International Conference on Solid State Sensors and Actuators; vol. 2, pp. 1133-1136.

IPRP for PCT/US07/009333, filed Apr. 17, 2007.

* cited by examiner

| | Column Output Signals | |
|---|---|---|
| | $+V_{bias}$ | $-V_{bias}$ |
| Row Output Signals | 0 | Stable | Stable |
| | $+\Delta V$ | Relax | Actuate |
| | $-\Delta V$ | Actuate | Relax |

POWER CONSUMPTION OPTIMIZED DISPLAY UPDATE

BACKGROUND OF THE INVENTION

Microelectromechanical systems (MEMS) include micro mechanical elements, actuators, and electronics. Micromechanical elements may be created using deposition, etching, and or other micromachining processes that etch away parts of substrates and/or deposit material layers or that add layers to form electrical and electromechanical devices. One type of MEMS device is called an interferometric modulator. As used herein, the term interferometric modulator or interferometric light modulator refers to a device that selectively absorbs and/or reflects light using the principles of optical interference. In certain embodiments, an interferometric modulator may comprise a pair of conductive plates, one or both of which may be transparent and/or reflective in whole or part and capable of relative motion upon application of an appropriate electrical signal. In a particular embodiment, one plate may comprise a stationary layer deposited on a substrate and the other plate may comprise a metallic membrane separated from the stationary layer by an air gap. As described herein in more detail, the position of one plate in relation to another can change the optical interference of light incident on the interferometric modulator. Such devices have a wide range of applications, and it would be beneficial in the art to utilize and/or modify the characteristics of these types of devices so that their features can be exploited in improving existing products and creating new products that have not yet been developed.

SUMMARY OF THE INVENTION

The system, method, and devices of the invention each have several aspects, no single one of which is solely responsible for its desirable attributes. Without limiting the scope of this invention, several of its features will now be discussed briefly.

One aspect of the invention includes a method of writing a display image to a display having an array of pixels. The method includes receiving image data, deriving a row-addressing order based at least in part on at least some of the stored image data, and writing the display image to the display by addressing rows in the array of pixels according to the row-addressing order.

In another embodiment, a method of determining a row-addressing order for an image includes determining one or more row attributes for one or more rows of the data in the image; and determining, based one or more row attributes, the row-addressing order.

In another embodiment, a method of displaying an image on a display is provided. The method includes receiving an image data file, the image data file including a row-addressing order. The method further includes creating the display image on the display by addressing the rows on the display according to the row-addressing order.

In yet another embodiment, a display apparatus is provided. The display apparatus includes a memory storing image data and a processor configured to receive the image data and calculate a row-addressing order based on a row attribute for one or more rows of the image data. The apparatus further includes a controller configured to present the image data to a display on a row-by-row basis according to the calculated row-addressing order.

In yet another embodiment, a display apparatus comprising means for receiving image data is provided. The display apparatus also includes means for deriving an addressing order based at least in part on one or more attributes of the image data and means for presenting the processed image data to a display in accordance with the derived addressing order.

In still another embodiment, a system is provided for displaying data on an array of interferometric modulators. The system may include a server configured to calculate an addressing order for image data. The system further includes a client device comprising a display and configured to receive the image data and the calculated addressing order from the server, and to display the image data on the array by addressing the array according to the addressing order.

DETAILED DESCRIPTION OF THE PREFERRED EMBODIMENT

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Conventional approaches to reducing power consumption in MEMS display devices have included various techniques that each tend to compromise the user experience by decreasing the quality of the image displayed to the user. These approaches have included decreasing the resolution or complexity of displayed images, decreasing the number of images in the sequence over a given time period, and decreasing the greyscale or color intensity depth of the image. In one or more embodiments of the present invention, a system and method is provided which allows a display device to be configured to reduce power consumption by determining a row-addressing order based on attributes of the image data, and reducing the number of column charging transitions necessary to write an image to the display. In other embodiments, the invention provides methods of adjusting pixel actuation patterns to minimally impact image quality but at the same time reduce the number of column charge transitions necessary to raster an image on a display.

Figure 1:
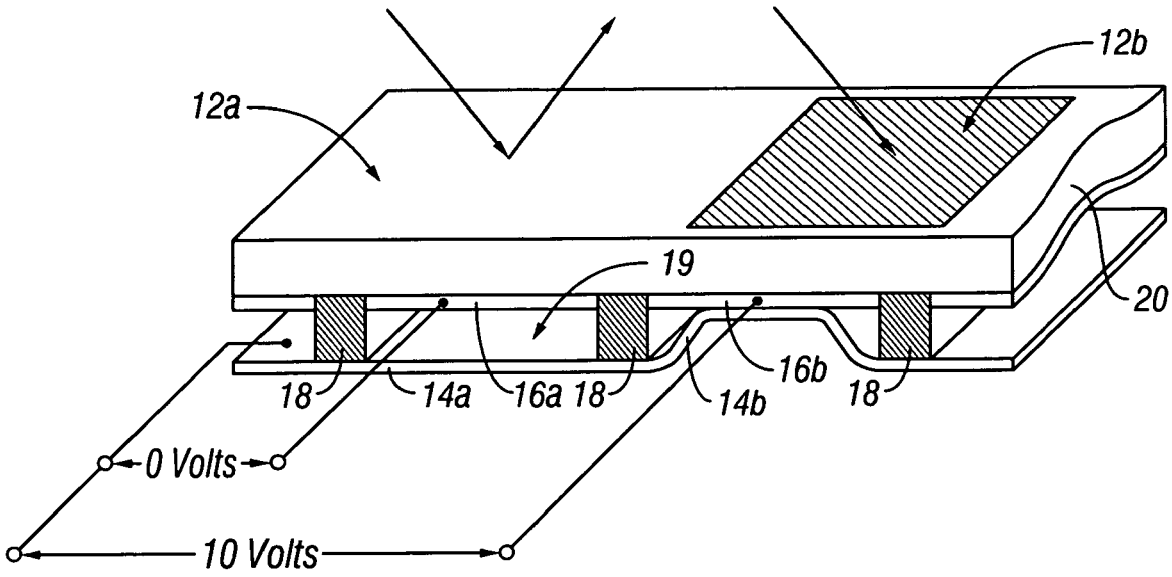
FIG. 1 is an isometric view depicting a portion of one embodiment of an interferometric modulator display in which a movable reflective layer of a first interferometric modulator is in a relaxed position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable reflective layer 14*a* is illustrated in a relaxed position at a predetermined distance from an optical stack 16*a*, which includes a partially reflective layer. In the interferometric modulator 12*b* on the right, the movable reflective layer 14*b* is illustrated in an actuated position adjacent to the optical stack 16*b*.

The optical stacks 16*a* and 16*b* (collectively referred to as optical stack 16), as referenced herein, typically comprise of several fused layers, which can include an electrode layer, such as indium tin oxide (ITO), a partially reflective layer, such as chromium, and a transparent dielectric. The optical stack 16 is thus electrically conductive, partially transparent and partially reflective, and may be fabricated, for example, by depositing one or more of the above layers onto a transparent substrate 20. The partially reflective layer can be formed from a variety of materials that are partially reflective such as various metals, semiconductors, and dielectrics. The partially reflective layer can be formed of one or more layers of materials, and each of the layers can be formed of a single material or a combination of materials.

In some embodiments, the layers of the optical stack are patterned into parallel strips, and may form row electrodes in a display device as described further below. The movable reflective layers 14*a*, 14*b* may be formed as a series of parallel strips of a deposited metal layer or layers (orthogonal to the row electrodes of 16*a*, 16*b*) deposited on top of posts 18 and an intervening sacrificial material deposited between the posts 18. When the sacrificial material is etched away, the movable reflective layers 14*a*, 14*b* are separated from the optical stacks 16*a*, 16*b* by a defined gap 19. A highly conductive and reflective material such as aluminum may be used for the reflective layers 14, and these strips may form column electrodes in a display device.

With no applied voltage, the cavity 19 remains between the movable reflective layer 14*a* and optical stack 16*a*, with the movable reflective layer 14*a* in a mechanically relaxed state, as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

FIGS. 2 through 5B illustrate one exemplary process and system for using an array of interferometric modulators in a display application.

Figure 2:
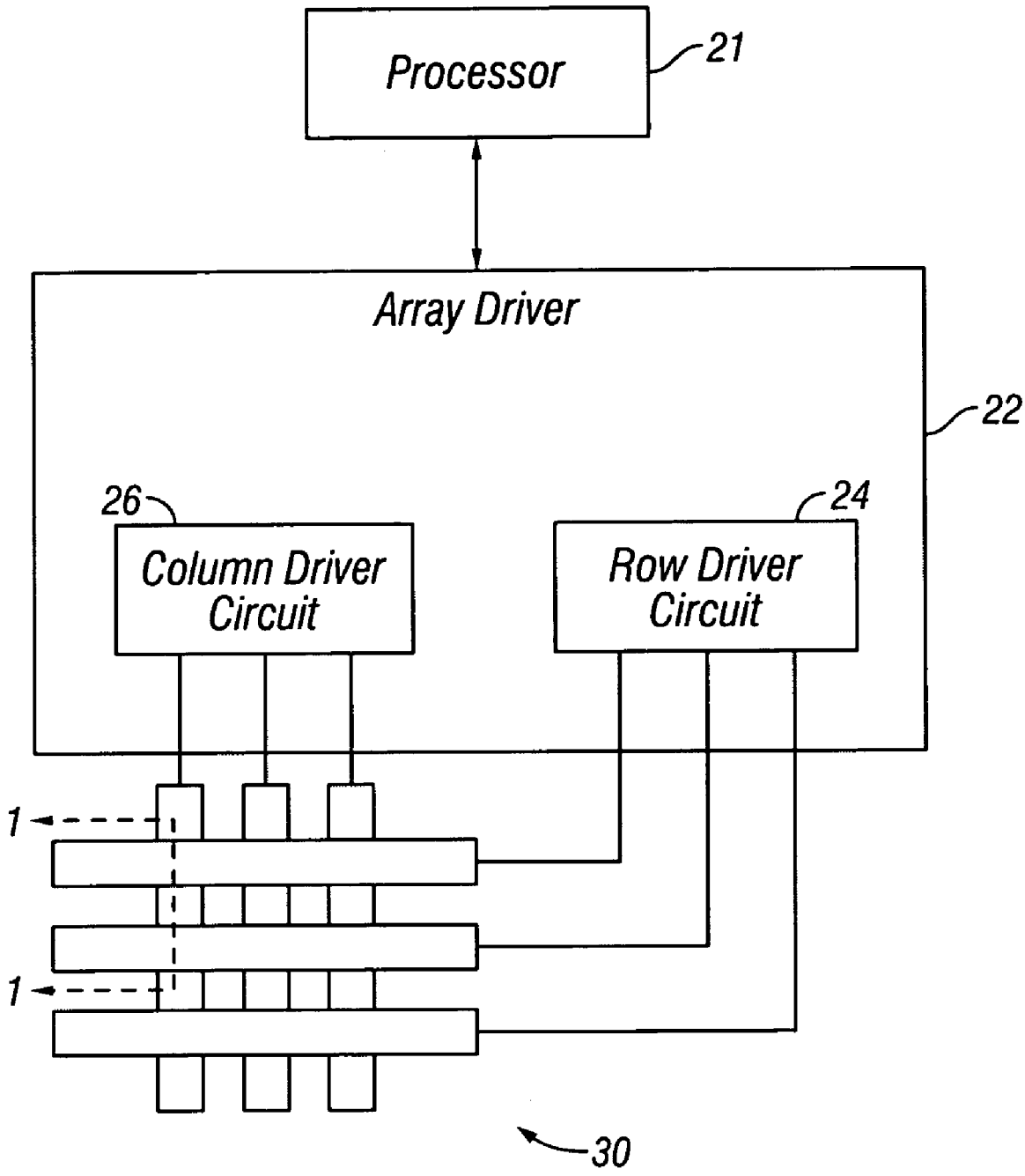
FIG. 2 is a system block diagram illustrating one embodiment of an electronic device incorporating a 3×3 interferometric modulator display.

FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array driver 22. In one embodiment, the array driver 22 includes a row driver circuit 24 and a column driver circuit 26 that provide signals to a display array or panel 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, an 8 volt potential difference to cause a movable layer to deform from the relaxed state to the actuated state. However, when the voltage is reduced from that value, the movable layer maintains its state as the voltage drops back below 8 volts. In the exemplary embodiment of FIG. 3, the movable layer does not relax completely until the voltage drops below 1 volt. There is thus a range of voltage, about 2 to 6 V in the example illustrated in FIG. 3, where there exists a window of applied voltage within which the device is stable in either the relaxed or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 8 volts, and pixels that are to be relaxed are exposed to a voltage difference of close to zero volts. After the strobe, the pixels are exposed to a steady state voltage difference of about 4 volts such that they remain in whatever state the row strobe put them in. After being written, each pixel sees a potential difference within the "stability window" of 2-6 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
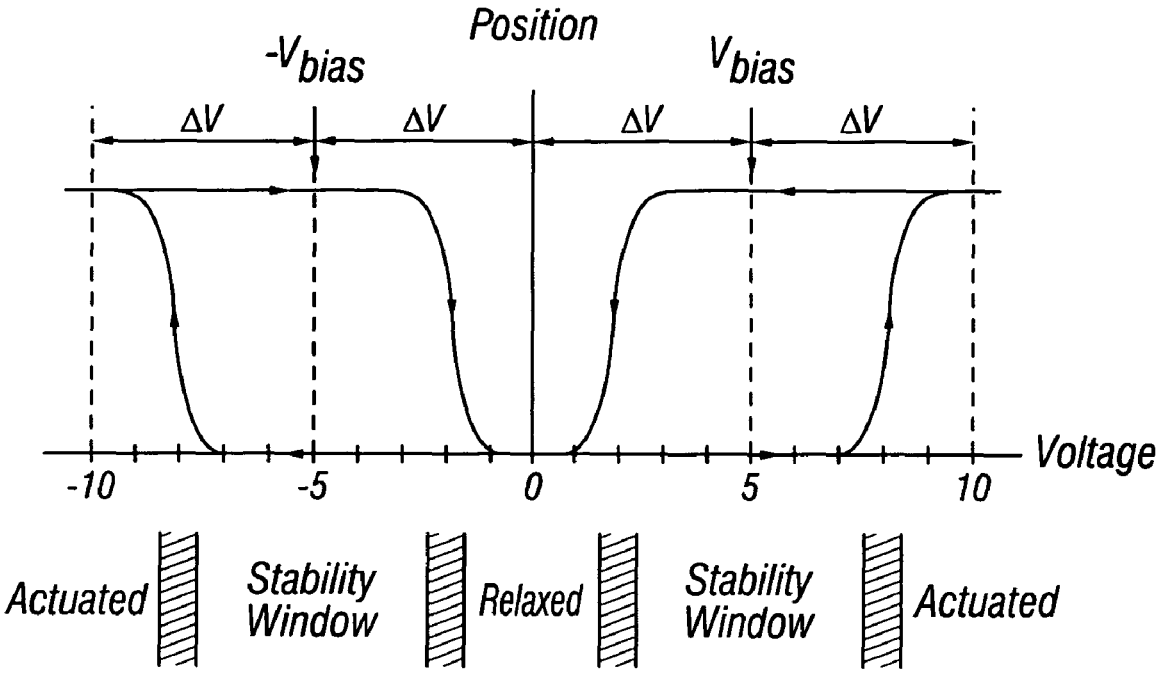
FIG. 3 is a diagram of movable mirror position versus applied voltage for one exemplary embodiment of an interferometric modulator of FIG. 1.
FIG. 4 is an illustration of two sets of row and column voltages that may be used to drive an interferometric modulator display.
Figure 5A:
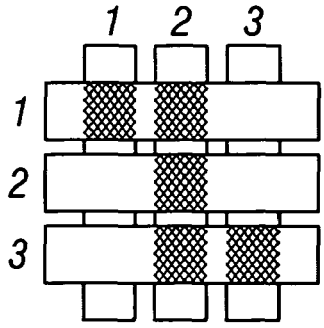
FIG. 5A illustrates one exemplary frame of display data in the 3×3 interferometric modulator display of FIG. 2.
Figure 5B:
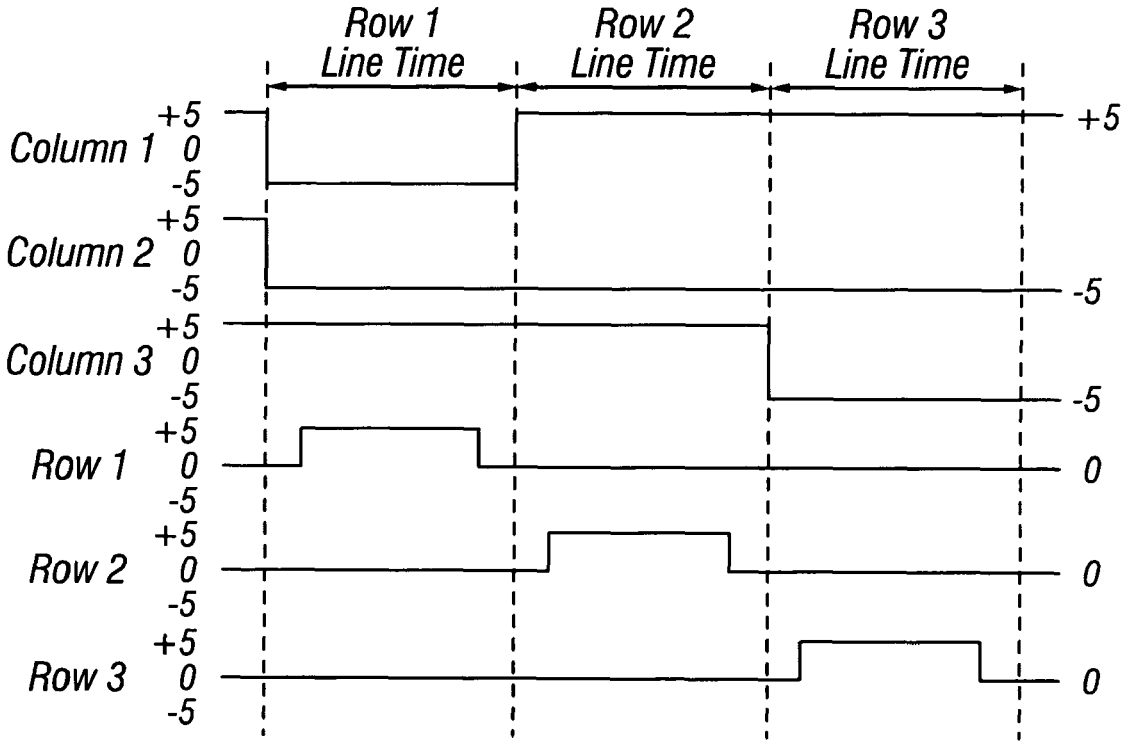
FIG. 5B illustrates one exemplary timing diagram for row and column signals that may be used to write the frame of FIG. 5A.

FIGS. 4, 5A, and 5B illustrate possible actuation protocols for creating a display frame on the 3×3 array of FIG. 2. FIG. 4 illustrates a possible set of column and row voltage levels that may be used for pixels exhibiting the hysteresis curves of FIG. 3. In the second row of the FIG. 4 embodiment, actuating a pixel involves setting the appropriate column to $-V_{bias}$, and the appropriate row to $+\Delta V$, which may correspond to −4 volts and +4 volts respectively Relaxing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. The last row of FIG. 4 illustrates an alternate embodiment, in which $-V_{bias}$ may correspond to 2 volts and $+\Delta V$ may correspond to 10 volts. The embodiment shown in the last row of FIG. 4 differs from the second row of FIG. 4 only in that each value is increased by 6 volts. One of skill in the art will appreciate that it is the voltage difference across the pixels that govern actuation/release patterns, and that the absolute values can be shifted.

As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or relaxed states.

In the FIG. 5A frame, pixels (1,1), (1,2), (2,2), (3,2) and (3,3) are actuated. To accomplish this, during a "line time" for row 1, columns 1 and 2 are set to −4 volts, and column 3 is set to +4 volts. This does not change the state of any pixels, because all the pixels remain in the 2-6 volt stability window. Row 1 is then strobed with a pulse that goes from 0, up to 4 volts, and back to zero. This actuates the (1,1) and (1,2) pixels and relaxes the (1,3) pixel. No other pixels in the array are affected. To set row 2 as desired, column 2 is set to −4 volts, and columns 1 and 3 are set to +4 volts. The same strobe applied to row 2 will then actuate pixel (2,2) and relax pixels (2,1) and (2,3). Again, no other pixels of the array are affected. Row 3 is similarly set by setting columns 2 and 3 to −4 volts, and column 1 to +4 volts. The row 3 strobe sets the row 3 pixels as shown in FIG. 5A. After writing the frame, the row potentials are zero, and the column potentials can remain at either +4 or −4 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the systems and methods described herein.

Figure 6A:
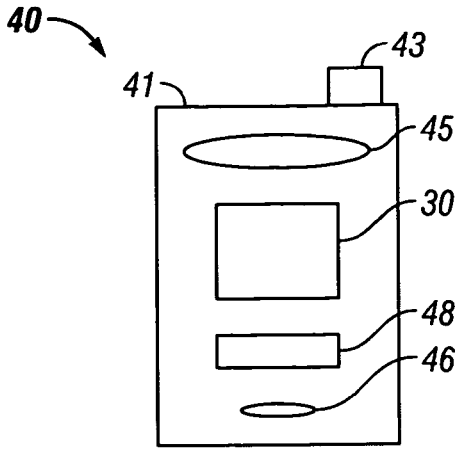
FIGS. 6A and 6B are system block diagrams illustrating an embodiment of a visual display device comprising a plurality of interferometric modulators.
Figure 6B:
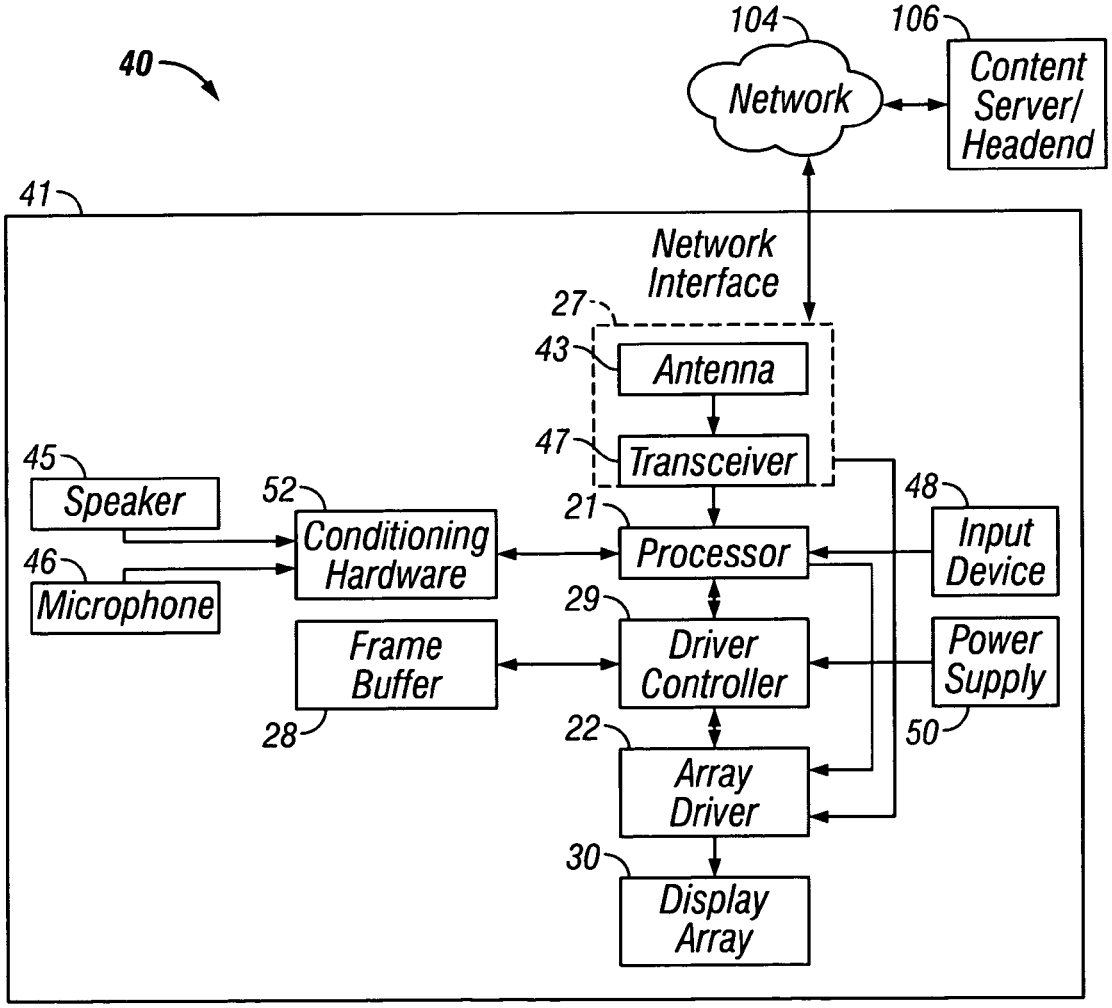

FIGS. 6A and 6B are system block diagrams illustrating an embodiment of a display device 40. The display device 40 can be, for example, a cellular or mobile telephone. However, the same components of display device 40 or slight variations thereof are also illustrative of various types of display devices such as televisions and portable media players.

The display device 40 includes a housing 41, a display 30, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 6B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and greyscale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators).

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet.

In some implementations control programmability resides, as described above, in a driver controller which can be located in several places in the electronic display system. In some cases control programmability resides in the array driver 22. Those of skill in the art will recognize that the above-described optimization may be implemented in any number of hardware and/or software components and in various configurations.

Figure 7A:
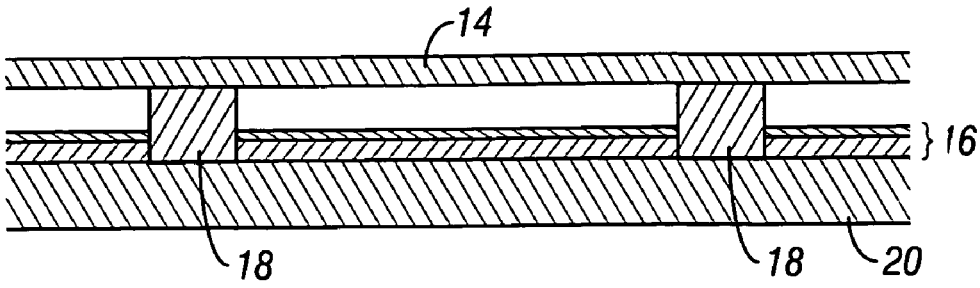
FIG. 7A is a cross section of the device of FIG. 1.
Figure 7B:
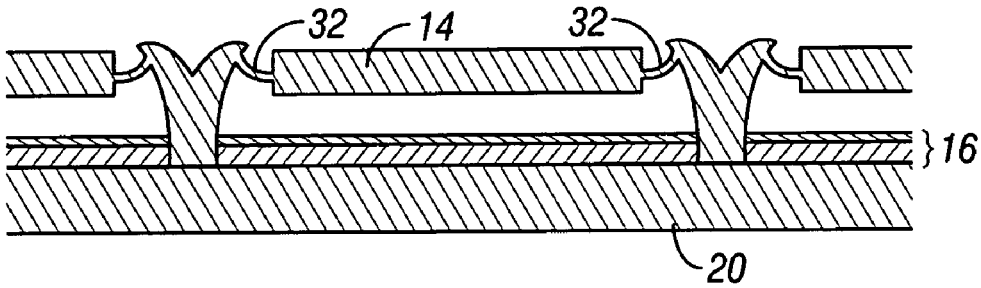
FIG. 7B is a cross section of an alternative embodiment of an interferometric modulator.
Figure 7C:
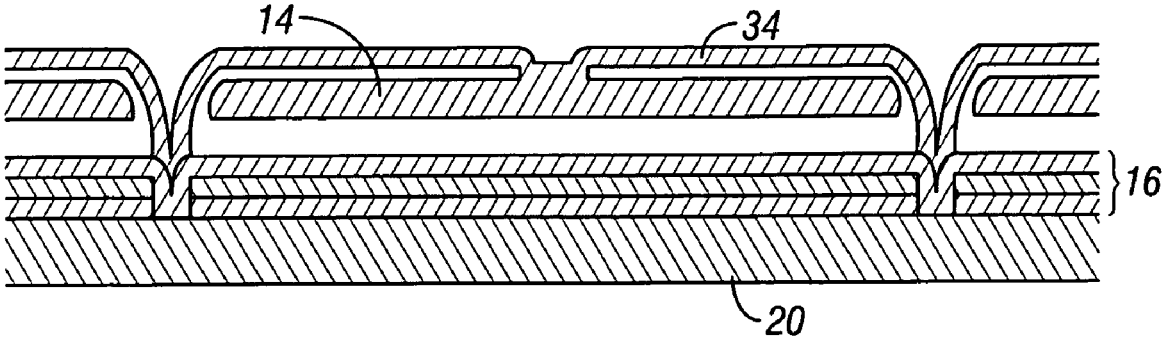
FIG. 7C is a cross section of another alternative embodiment of an interferometric modulator.
Figure 7D:
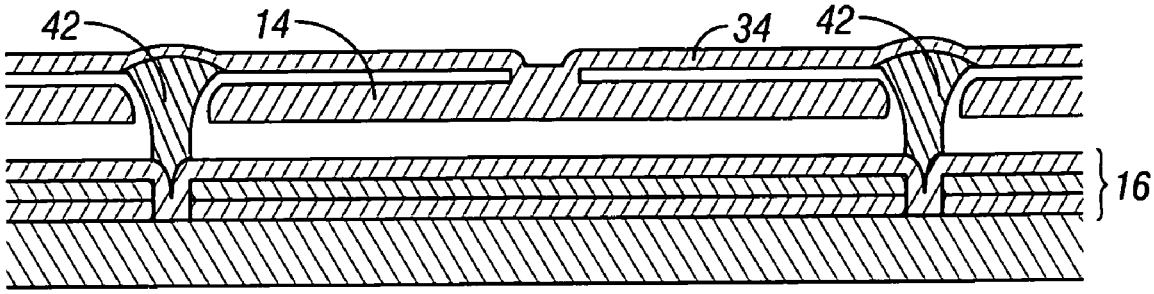
FIG. 7D is a cross section of yet another alternative embodiment of an interferometric modulator.
Figure 7E:
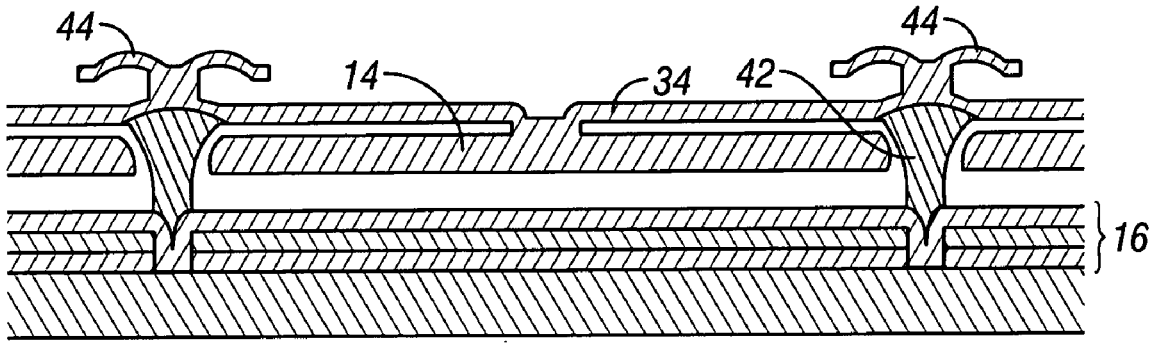
FIG. 7E is a cross section of an additional alternative embodiment of an interferometric modulator.

The details of the structure of interferometric modulators that operate in accordance with the principles set forth above may vary widely. For example, FIGS. 7A-7E illustrate five different embodiments of the movable reflective layer 14 and its supporting structures. FIG. 7A is a cross section of the embodiment of FIG. 1, where a strip of metal material 14 is deposited on orthogonally extending supports 18. In FIG. 7B, the moveable reflective layer 14 is attached to supports at the corners only, on tethers 32. In FIG. 7C, the moveable reflective layer 14 is suspended from a deformable layer 34, which may comprise a flexible metal. The deformable layer 34 connects, directly or indirectly, to the substrate 20 around the perimeter of the deformable layer 34. These connections are herein referred to as support posts. The embodiment illustrated in FIG. 7D has support post plugs 42 upon which the deformable layer 34 rests. The movable reflective layer 14 remains suspended over the cavity, as in FIGS. 7A-7C, but the deformable layer 34 does not form the support posts by filling holes between the deformable layer 34 and the optical stack 16. Rather, the support posts are formed of a planarization material, which is used to form support post plugs 42. The embodiment illustrated in FIG. 7E is based on the embodiment shown in FIG. 7D, but may also be adapted to work with any of the embodiments illustrated in FIGS. 7A-7C as well as additional embodiments not shown. In the embodiment shown in FIG. 7E, an extra layer of metal or other conductive material has been used to form a bus structure 44. This allows signal routing along the back of the interferometric modulators, eliminating a number of electrodes that may otherwise have had to be formed on the substrate 20.

In embodiments such as those shown in FIG. 7, the interferometric modulators function as direct-view devices, in which images are viewed from the front side of the transparent substrate 20, the side opposite to that upon which the modulator is arranged. In these embodiments, the reflective layer 14 optically shields the portions of the interferometric modulator on the side of the reflective layer opposite the substrate 20, including the deformable layer 34. This allows the shielded areas to be configured and operated upon without negatively affecting the image quality. Such shielding allows the bus structure 44 in FIG. 7E, which provides the ability to separate the optical properties of the modulator from the electromechanical properties of the modulator, such as addressing and the movements that result from that addressing. This separable modulator architecture allows the structural design and materials used for the electromechanical aspects and the optical aspects of the modulator to be selected and to function independently of each other. Moreover, the embodiments shown in FIGS. 7C-7E have additional benefits deriving from the decoupling of the optical properties of the reflective layer 14 from its mechanical properties, which are carried out by the deformable layer 34. This allows the structural design and materials used for the reflective layer 14 to be optimized with respect to the optical properties, and the structural design and materials used for the deformable layer 34 to be optimized with respect to desired mechanical properties.

A major factor determining the power consumed by driving an interferometric modulator display is the charging and discharging the line capacitance for the columns receiving the image data. This is due to the fact that the column voltages are switched at a very high frequency (up to the number of rows in the array minus one per column for each frame update period), compared to the relatively low frequency of the row pulses (one pulse per row per frame update period). In fact, the power consumed by the row pulses generated by row driver circuit may be ignored when estimating the power consumed in driving a display without sacrificing an accurate estimate of total power consumed. Accordingly, the term "column" as used herein is defined as the set of display inputs that receive image data at a relatively high signal transition frequency. The term "rows" is defined as the set of display inputs that receive a periodic applied signal that is independent of the display data and is applied at a relatively low frequency to each row, such as the row strobes described above. The terms "row" and "column" do not therefore imply any geometric position or relationship.

The basic equation for estimating the energy consumed by writing to an entire column, ignoring row pulse energy, is:

$$(\text{Energy/col})=\tfrac{1}{2}*\text{count}*C_{line}*|V_{CH}^2-V_{CL}^2| \quad (1)$$

The power consumed in driving an entire array is simply the energy required for writing to every column divided by time or:

$$\text{Power}=\Sigma[\text{Energy/col}]*f \quad (2)$$

where:

count=number of transitions from $V_{CH}$ to $V_{CL}$ (and vice versa) required on a given column to display data for all rows $V_{CH}$=the greater of two voltages applied to a column $V_{CL}$=the lesser of the voltages applied to a column $C_{line}$=capacitance of a column line f=the frame update frequency (Hz)

It should be noted that these equations are applicable to driving voltages such as those shown in FIG. 4B. Similar equations apply when negative voltages are used.

For a given frame update frequency (f) and frame size (number of columns), the power required to write to the display is linearly dependent on the frequency of the data being written. Of particular interest is the "count" variable in (1), which depends on the frequency of changes in pixel states (actuated or relaxed) in a given column. Thus, by reducing the number of column voltage transitions involved in writing to the display, the amount of power consumed by the display is reduced. Currently, displays are addressed row-by-row, usually in a top-to-bottom order as described above with respect to FIGS. 5A and 5B. Addressing rows top-to-bottom may require many column voltage transitions to write a frame of image data to the display because the image data down a column may flip back and forth between "on" and "off" states a large number of times as the system proceeds through the set of rows in a linear top-down fashion.

Some embodiments of the invention involve utilizing a row-addressing order based on attributes of image data in order to update a display array using a reduced number of column voltage transitions. In order to reduce the number of column charge transitions, the system can create a row-addressing order based on the content of the image data. By ordering the row addressing with image content in mind, similar rows can be strobed one after the other, thereby reducing the total number of column transitions needed to write an image to the display.

FIG. 8 illustrates an example of a prior art top-to-bottom implementation of column charge transitions and row addressing in a 5×5 array of display elements 12. The 5×5 array 50 may comprise a portion or all of display array 30 as described above. FIG. 8A provides an example image being written to the 5×5 array 50. In this example, the entire first, third, and fifth rows have display elements in the non-reflective state. As used herein, a pixel element (or sub-element) in the non-reflective state may also be referred to as being "dark" or in an actuated state such as pixel 12*b* in FIG. 1. The second and fourth rows are in a released state, also referred to as a reflective, "white," or non-actuated state such as pixel or display element 12*a* in FIG. 1.

Figure 8A:
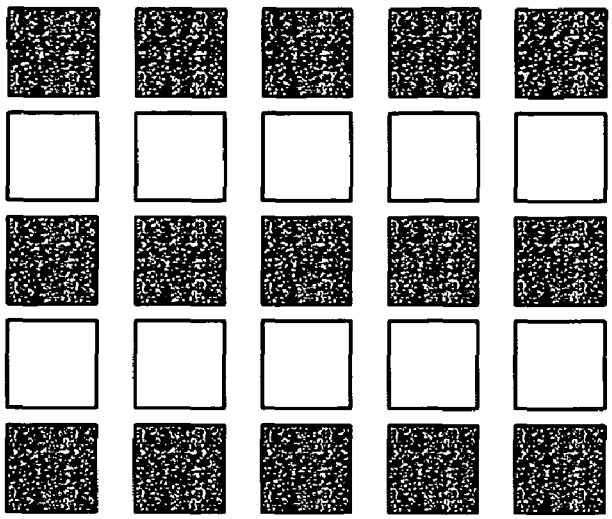
FIGS. 8A-8F form an example of a prior art implementation of top to bottom row addressing.
Figure 8B:
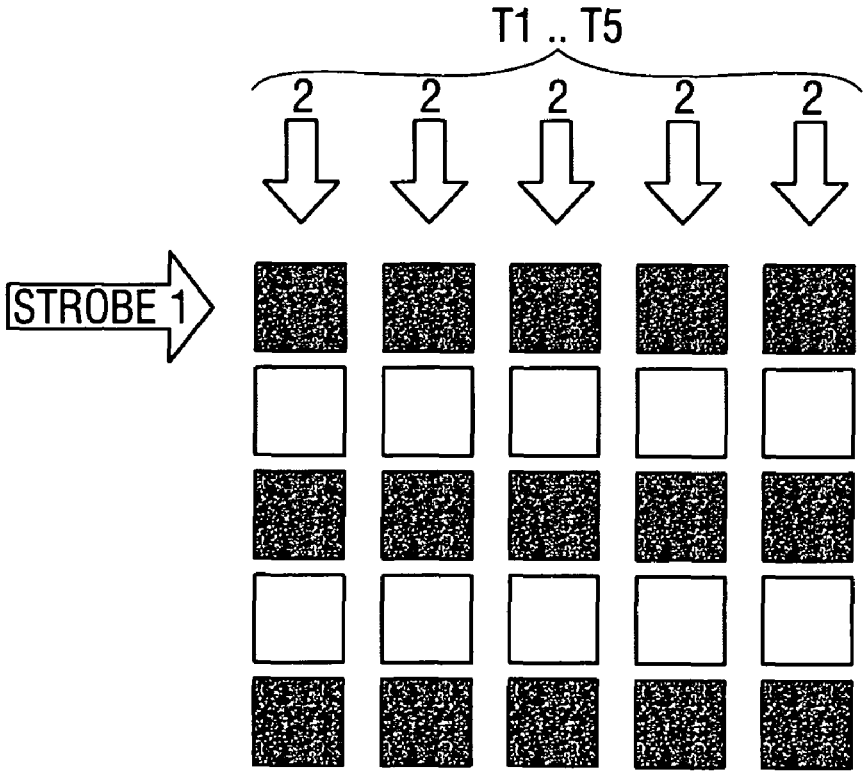
FIG. 8B (Prior Art)

FIGS. 8B through 8F illustrate the column transitions necessary to display the pixel actuation scheme shown in FIG. 8A using a conventional addressing ordering scheme. As discussed previously, the row-addressing order will proceed from top to bottom, with the necessary column charge transitions being performed to achieve the pixel image shown in FIG. 8A. Referring now to FIG. 8B, five column charge transitions, T1 . . . T5 are shown. Because the image data indicates that each display element 12 in the first row should be actuated, each column charge transition sets the column voltage to the actuation voltage. If the row strobe goes from 6 to 10 (e.g., in accordance with FIG. 4B), then this voltage would be 2 as illustrated in FIG. 8B. Thus, when the first row is strobed, each of the display elements in row 1 is actuated.

Figure 8C:
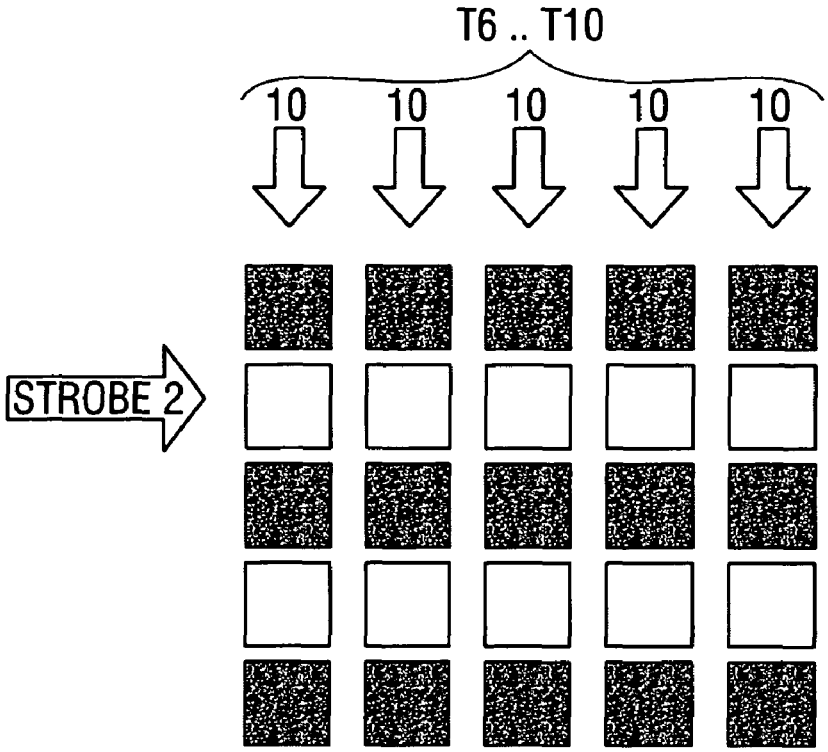
FIG. 8C (Prior Art)

Now referring to FIG. 8C, the second row is addressed. Because the image data provides for five non-actuated display elements in the second row, the column voltage for each column is transitioned from the actuation voltage (e.g., 2V) to the release voltage (e.g., 10V) in transitions T6 . . . T10. After transitioning the column voltage for each column, each of the display elements 12 in the second row is strobed so that each display element in the second row is released.

Figure 8D:
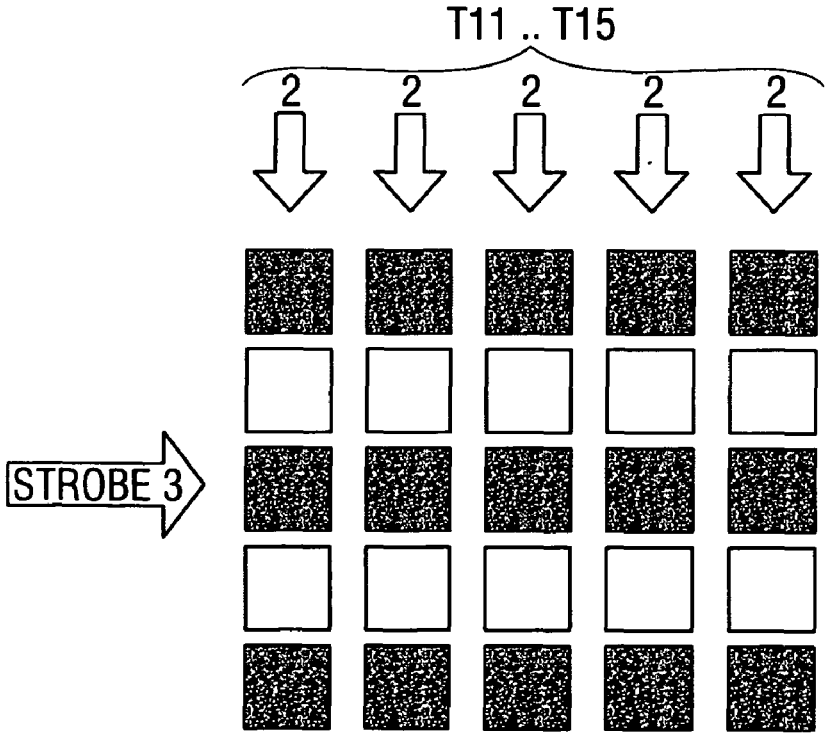
FIG. 8D (Prior Art)
Figure 8E:
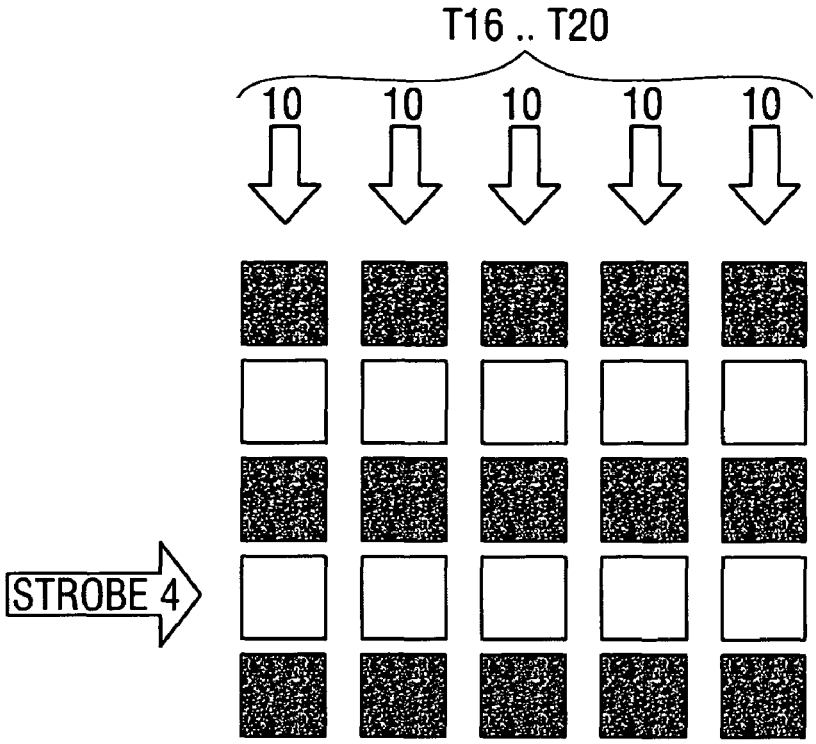
FIG. 8E (Prior Art)

Like the first row, the image data indicates that the display elements in the third row should be actuated. FIG. 8D shows five additional column voltage transitions T11 . . . T15 that set the column voltage to the actuation voltage. The row is strobed, and each display element 12 is actuated by the strobing pulse. FIG. 8E illustrates how each of the display elements 12 in the fourth row is released. Because the previous row's display elements were each actuated, in order to release the display elements in the fourth row, the column voltage must be transitioned for each column by transitions T16 . . . T20. Upon completion of the column voltage transitions, the fourth row is strobed, resulting in the release of each display element in the row.

Figure 8F:
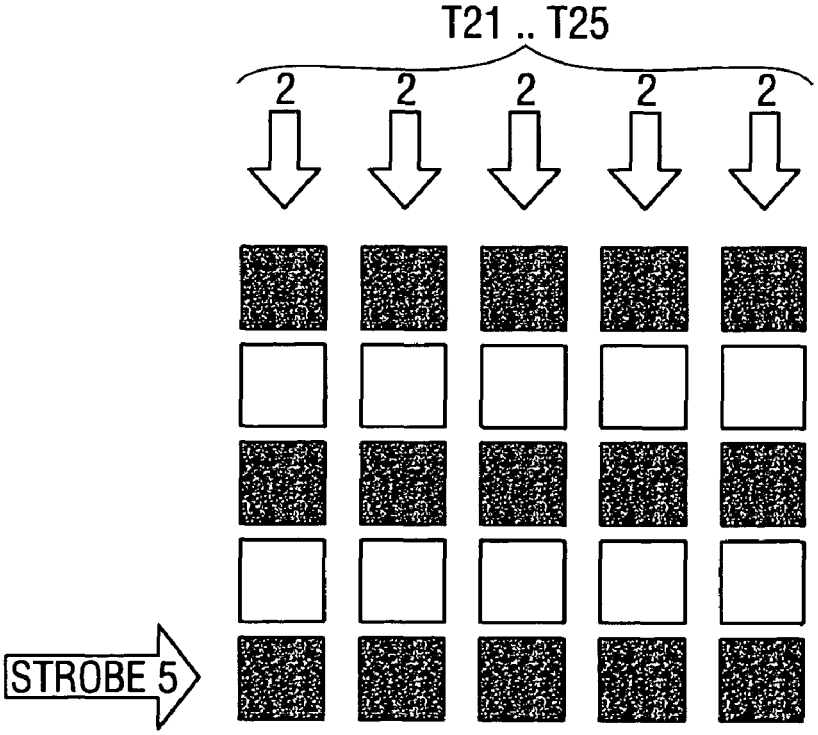
FIG. 8F (Prior Art)

In FIG. 8F, the fifth row in display array 30 is addressed. Each column is again transitioned from the release voltage to the actuation voltage because the previous row was white, and the current (fifth) row is dark. Thus, column charge transitions T21 through T25 set the column charge to the actuation voltage, and a row strobe actuates the appropriate display elements 12 in display array 30.

In the conventional process shown in FIG. 8, twenty-five column voltage transitions were used to create the pixel actuation pattern. Because each column voltage transition consumes power, it is desirable to reduce the number of column voltage transitions when creating the display.

Figure 9A:
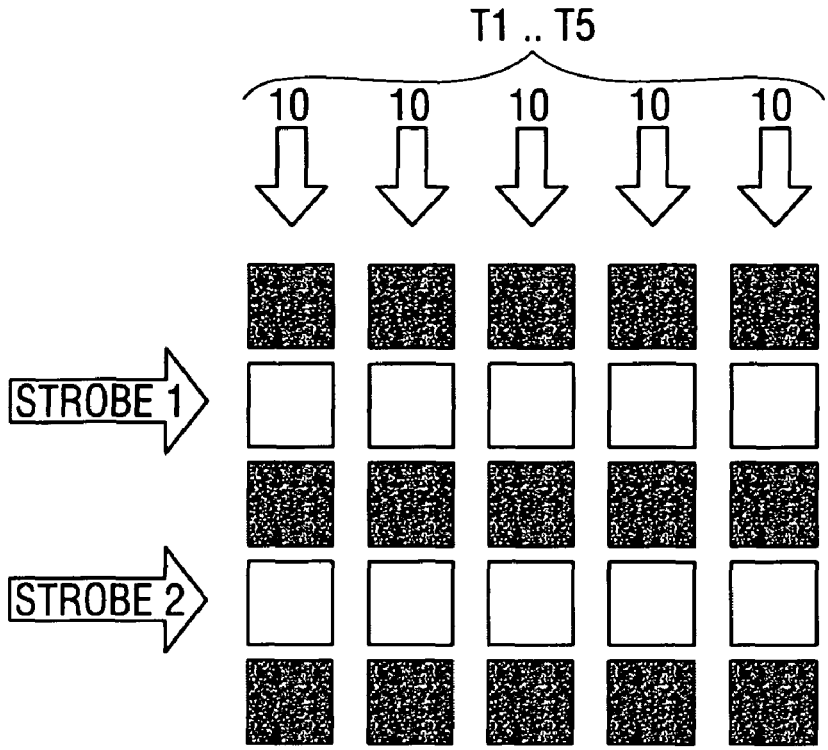
FIGS. 9A-9B form an example of implementing a row-addressing order based on the whiteness of each row.
Figure 9B:
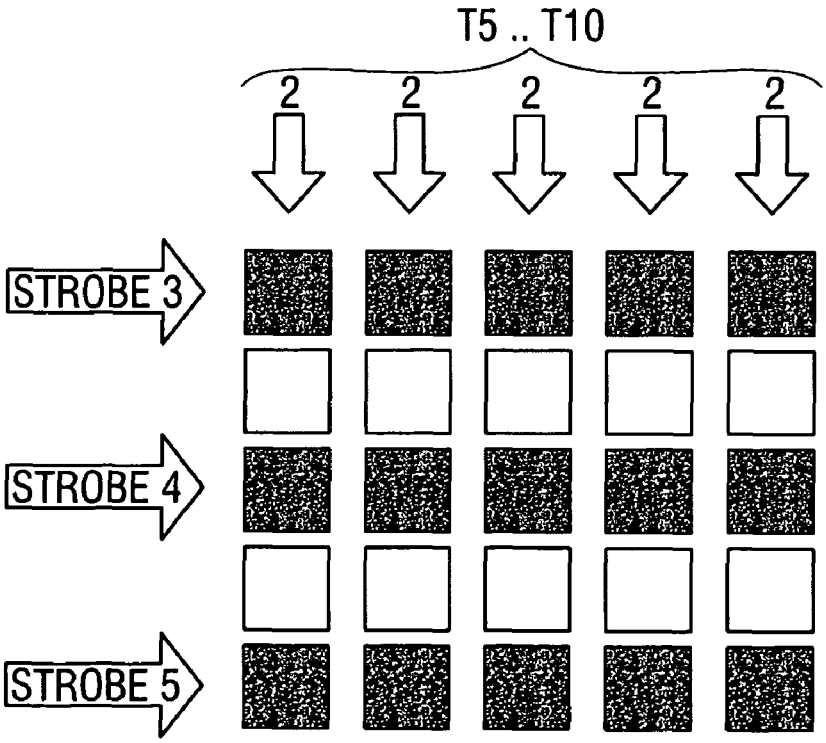

In one embodiment of the invention, the number of column charge transitions are reduced by setting a row-addressing order based on an attribute of the display data. Referring now to FIGS. 9A and 9B another 5×5 display array 60 is provided which has an identical actuation pattern to the display array previously discussed in FIG. 8. By predetermining a row-addressing order based on an attribute of the image data, the number of column charge transitions is reduced significantly. In the case of FIG. 9, the attribute upon which the row-addressing order is based is the "whiteness" of each row. Thus, those rows with the most white (or released) pixels are addressed first, and those with the fewest are addressed last.

FIG. 9A illustrates column charge transitions T1 . . . T5, which set each column to the release voltage. Once the columns have been charged, each of the white rows (rows 2 and 4 in this instance) is sequentially strobed to cause each display element 12 in the row to be released. Thus, two of the five rows of display elements have been created with only a total of five column charging transitions. Next, in FIG. 9B, the column potentials are transitioned in each column by transitions T6 . . . T10. After the transition, rows 1, 3, and 5 are sequentially strobed, causing the actuation of each display element 12 situated in the strobed rows. Thus, image is written to display array 60 using only ten column charging transitions, instead of 25, a 60% savings in power over the top to bottom addressing order of FIG. 8.

This data dependent row addressing order can be performed on any set of image data to reduce column transitions. Tables 1 and 2 below also illustrate this row-addressing scheme as it can be applied to the actuation pattern shown in FIG. 9. Image data analysis may, for example, involve first counting and tabulating the number of released pixels in each row. Table 1 shows for each row, how many of the pixels are released for the image of FIG. 9. For rows 1, 3, and 5, 0 out of the 5 pixels in the row are white pixels. In rows 2 and 4, each of the pixels (i.e., 5 out of 5) is white. It will be appreciated that this counting could be performed for a display of any size, and with any variation of display data.

TABLE 1

| | Row # | | | | |
|---|---|---|---|---|---|
| | 1 | 2 | 3 | 4 | 5 |
| # White Pixels | 0 | 5 | 0 | 5 | 0 |

Given the pixel patterns described in Table 1, a row-addressing order may be derived by placing the rows in order from the most number of released pixels to the least, as shown in Table 2. For rows with the same number of released pixels, a random order or numerical order could be used to create an order within groups of rows having the same number of released pixels. Table 2 illustrates this sorting for the image of FIG. 9.

TABLE 2

| Address Order | Row # | White Pixels |
|---|---|---|
| 1 | 2 | 5 |
| 2 | 4 | 5 |
| 3 | 1 | 0 |
| 4 | 3 | 0 |
| 5 | 5 | 0 |

In the examples provided in FIGS. 8 and 9 and Tables 1 and 2, each row was uniform in its actuation pattern. Each display element 12 in the first, third, and fifth rows was actuated, while each display element 12 in the second and fourth rows was released.

Basing the row-addressing order on the "whiteness" of the row was very effective for the image of FIG. 9 because of the row uniformity. For other images with a narrower distribution of row whiteness the effectiveness will vary. In general, however, significant power reductions can be expected, especially when displaying images having regions of uniformity within them.

Furthermore, if the rows containing predominantly released pixels are written first, the line capacitance of the columns will decrease as the image is written, providing additional power reduction benefits.

Figure 10A:
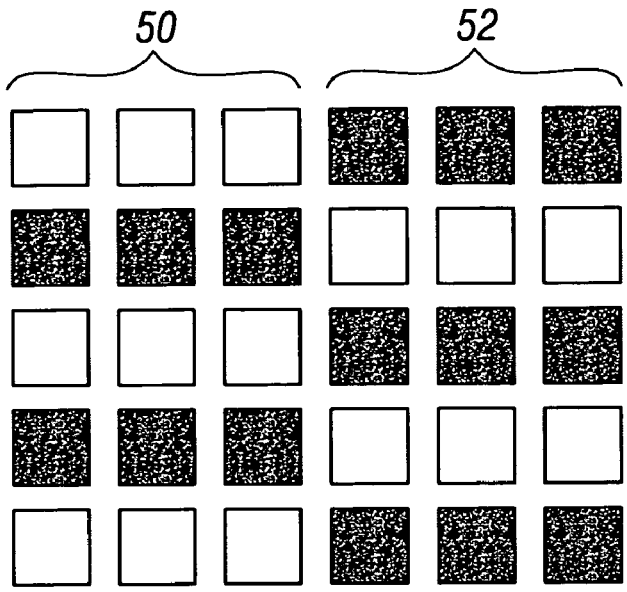
FIGS. 10A-10C form an example of determining a row addressing order using whiteness of sub-rows.
Figure 10B:
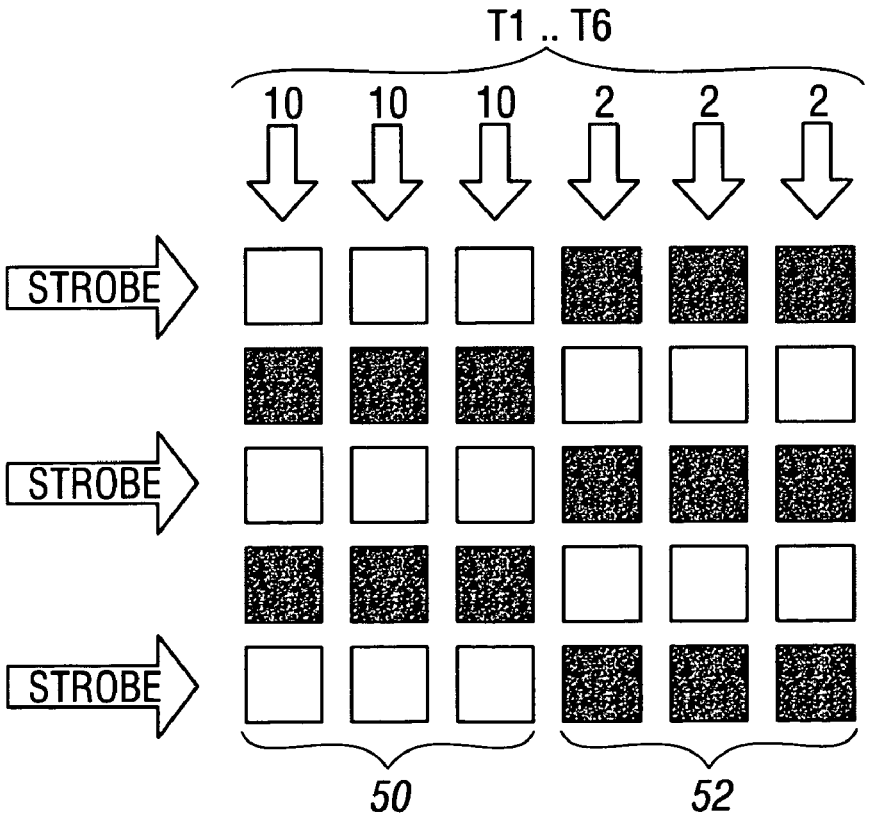
Figure 10C:
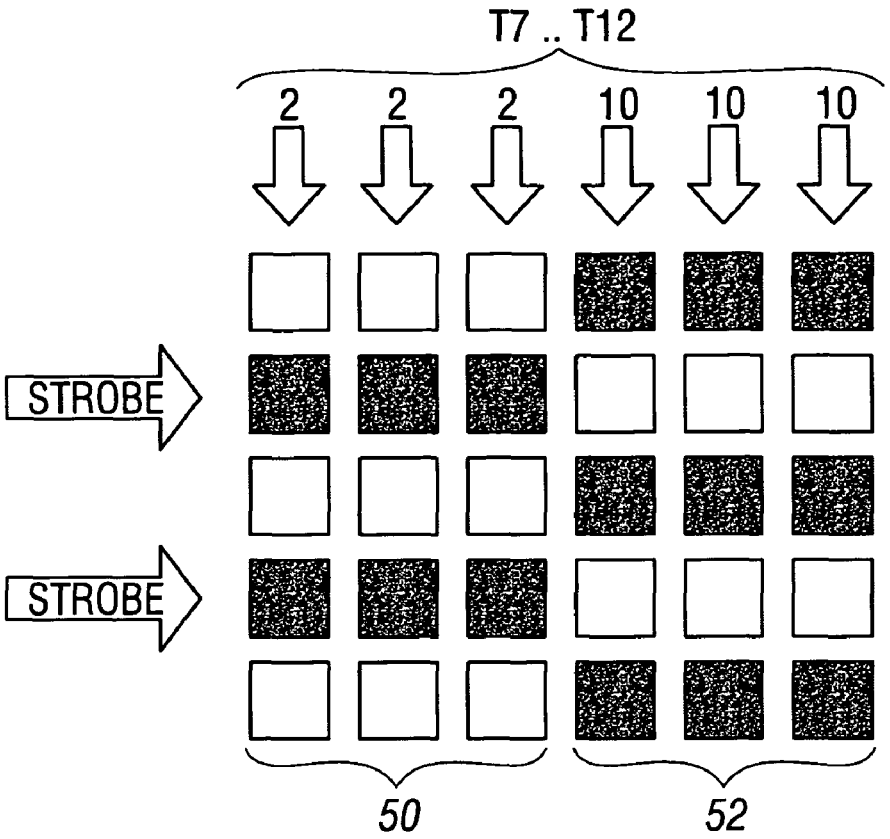

For images or portions of images having rows with similar overall whiteness, more complicated row analysis can be performed to produce significant power reduction. FIG. 10 provides an example of an image where ordering based on row whiteness alone provides no real advantage. In this image, because the rows each have three white pixels and three dark pixels, setting the row-addressing order based on the "whiteness" of the rows would not result in a change in the default top-to-bottom addressing order that was shown in FIG. 8, as each row is similar in whiteness. Thus, fully writing this image to a display array would require a total of 30 column charging transitions using the process described in either FIG. 8 or FIG. 9.

To resolve this problem with images such as illustrated in FIG. 10, rather than determining the row-addressing order based on an attribute of the entire row, a row-addressing order is created based on attributes of each half of each row. Tables 3-5 (shown below) provide an example of how the row addressing order may be based on the left and right halves of a row (left sub-row 50 and right sub-row 52) to reduce column charging transitions necessary to create an image.

In this embodiment, the row is split into sub-rows 50 and 52 and the "whiteness" value is determined for each. Those rows in which both of sub-rows 50 and 52 are predominantly white are placed at the top of the row-addressing order. Rows in which left sub-row 50 is predominantly white and right sub-row 52 is not predominantly white are placed next in the addressing order. Rows in which right sub-row 52 is predominantly white and left sub-row 50 is not predominantly white are addressed next. Rows in which both sub-rows are not predominantly white are addressed last. Tables 3-5 show how this scheme may be applied to the to the actuation pattern of FIG. 10.

Table 3 shows the number of "white" pixels in left sub-row 50 in each of the rows of the pixel array. In rows 1, 3, and 5, three out of three of the pixels on the left are white. In rows 2 and 4, none of the three pixels on the left are white.

TABLE 3

(Left Sub-Row)

| | Row # | | | | |
|---|---|---|---|---|---|
| | 1 | 2 | 3 | 4 | 5 |
| # White Pixels | 3 | 0 | 3 | 0 | 3 |

Table 4 shows the number of "white" pixels in right sub-row 52 of each row of the pixel array. Rows 1, 3, and 5 each have no white pixels on the right half, while in rows 2 and 4, each of the pixels is white on the right half.

TABLE 4

(Right Sub-Row)

| | Row # | | | | |
|---|---|---|---|---|---|
| | 1 | 2 | 3 | 4 | 5 |
| # White Pixels | 0 | 3 | 0 | 3 | 0 |

Because there are no rows in which both the left sub-row 50 and the right sub-row 52 are predominantly white, the row-addressing order in Table 5 begins with those rows in which left sub-row 50 is predominantly white and right sub-row 52 is not predominantly white. Thus, rows 1, 3, and 5 are placed at the top of the order. Rows 2 and 4 are then placed next in the order because they have predominantly white right sub-rows 52 and predominantly dark left sub-rows 50. Although there are no rows in which both the left sub-row and right sub-row are not predominantly white, if there were, they would be placed last in the row-addressing order.

TABLE 5

(Row-Addressing Order)

| Address Order | Row # | White Pixels Left | White Pixels Right |
|---|---|---|---|
| 1 | 1 | 3 | 0 |
| 2 | 3 | 3 | 0 |
| 3 | 5 | 3 | 0 |
| 4 | 2 | 0 | 3 |
| 5 | 4 | 0 | 3 |

This dramatically reduces the number of column transitions necessary to write the frame of FIG. 10 over a top down addressing order. It will be appreciated that this same procedure could be applied to row quarters, eights, sixteenths, etc. with the benefit of more accurate row order determination and lower power, but at the cost of additional computational complexity.

Figure 11:
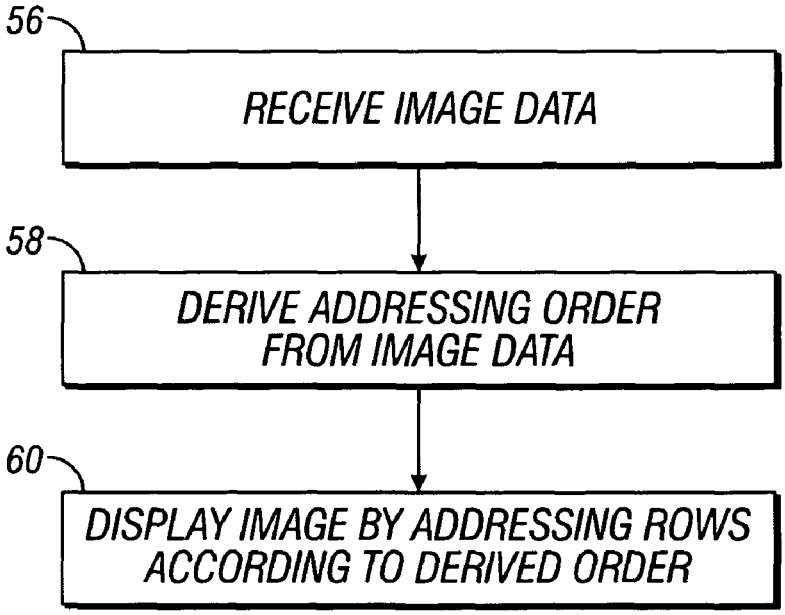
FIG. 11 is a flowchart illustrating a method for writing a display image on a display array.

A general method is shown in FIG. 11 in which a display image may be created on display array 30. Display array 30 may advantageously comprise a MEMS display or other type of bi-stable display that includes pixels having actuated and unactuated states. At block 56, image data is received by the system. The image data may be received into display device 40 by way of user input interface 48, network interface 27, or it may be created by system processor 21 in response to a system event.

At block 58, display device 40 derives a row-addressing order based at least in part on part on attributes of the image data. The row addressing order may be stored in a register bank which is accessed by array driver 22 or driver controller 29 prior to writing image data to display array 30.

Depending upon the embodiment, the row-addressing order may be derived from various sources. In one embodiment, the row-addressing order is derived from an attribute of one or more rows of the image data. For example, the attribute might be the number of actuated pixels in the row and/or the number of unactuated pixels in the row. In yet another embodiment, the attribute may consider the "sameness" of various rows, i.e., the similarities between groups of rows. For example, in processing the image, the system processor 22 may determine that a number of non-adjacent rows have very similar or identical pixel actuation patterns. The row-addressing order may take this similarity into account, and place these rows together in the row-addressing order because few column charge transitions would be required to write the display data to the identical or similar rows.

Lastly, at block 60, a display image is written to display array 30 by addressing rows in display array 30 according to the derived addressing order.

Although these embodiments have been described in terms of a row addressing order in which columns are charged to actuation and release voltages, one of skill in the art will readily appreciate that the invention may be easily implemented in a display device in which columns are strobed and rows are charged to actuation voltages and release voltages.

It will be appreciated that a row addressing order suitable for power reduction for a given frame need not be computed or derived in the array driver or processor local to the display itself. In some advantageous embodiments, a content provider can derive a suitable row addressing order and transmit the order to the display device along with the image data itself.

Figure 12:
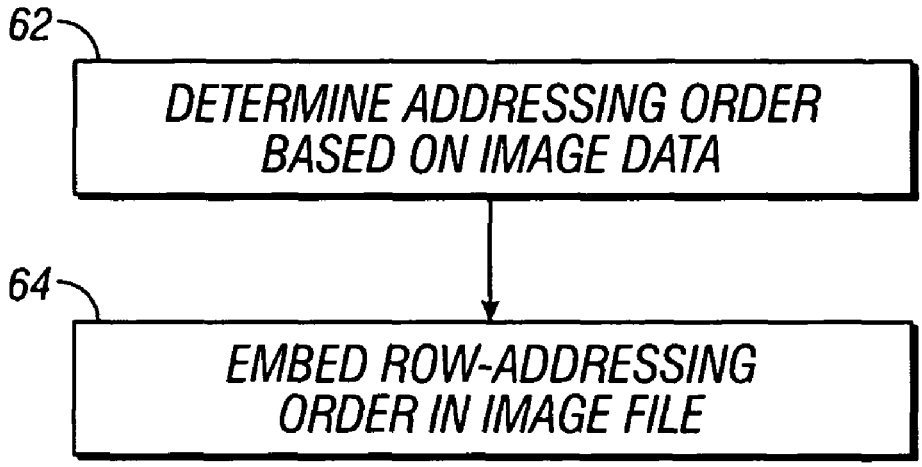
FIG. 12 is a flowchart illustrating a method of determining a row-addressing order in a display device.

An example method of this type is provided in FIG. 12. At state 62, a row addressing order is determined based at least in part on the image data. As described above, this may involve determining one or more row attributes for one or more rows of image data. For example, the row attributes may be determined by calculating the ratio of pixels or display elements in an actuated state to pixels or display elements in a non-actuated (i.e., released) state. The image data may not be in a format that directly indicates actuated and released pixels. In this case, it is possible to use substitute image information indicating the lightness or darkness of an image region or differences between image frames or regions of image frames. A variety of analyses can be performed that provide an indication of pixel actuation states along a row and that can be used to determine a row addressing order that will reduce energy consumption of the display device when the frame is written.

After determining the row-addressing order, at state 64, the row-addressing order is embedded in the image file itself. In some embodiments, these steps may take place when the image data is created. In other embodiments, the row-addressing order for the image may be determined by a networked computer or system such as a content server or headend server 106 in a network 104 as shown in FIG. 6B. It will further be appreciated that the addressing order for an image need not be made part of the image data itself. It can be transferred as part of an image header, or transmitted separately from the image data over the same or a different communications path.

Figure 13:
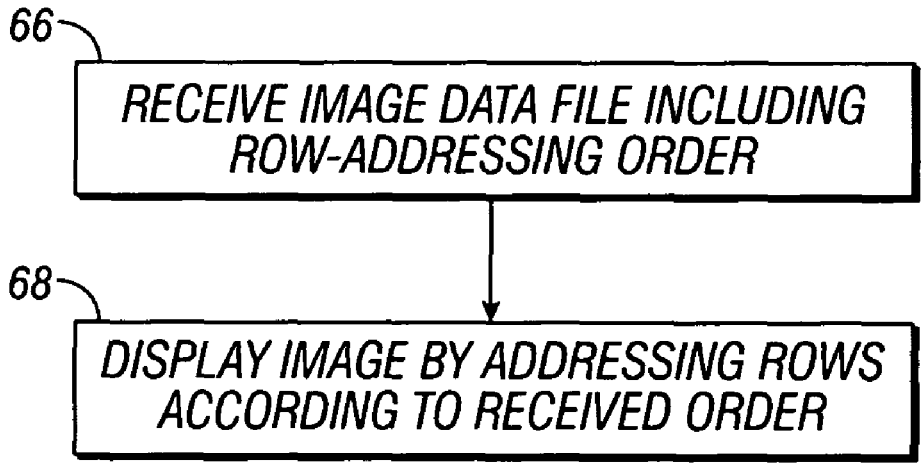
FIG. 13 illustrates a method for receiving and displaying an image using an addressing order included in the received image data.

FIG. 13 illustrates a method implemented in the display device for receiving and displaying an image when a row-addressing order is included in the image file. At state 66, the display device may receive an image file which has a row-addressing order included with the image data. As described above, the row addressing order need not be in the image data itself, but may be received separately in some embodiments. In one embodiment, the image file may be received via the network interface 27, or it may be received via some other external data source such as a memory, a digital camera, or any other image data source that is external to display device.

At state 68, the display device writes the display image on the display array by addressing the rows in the order set forth by the row-addressing order. Thus, a display device may be configured to display image data according to an image dependent row-addressing order without having to perform computationally expensive calculations in determining that order.

In would also be possible to look at the row pixel patterns on a small scale, and perform minor modifications to the image data to reduce the number of column transitions when the proper row addressing order is utilized. In general, this may involve taking rows that are nearly identical in actuation pattern, and making them exactly identical. If this is performed for rows that are relatively widely separated from each other in the image, this will not affect the visual appearance, but will reduce the power required to write the image. These changes could be made close together while using an algorithm that holds local image values constant. This technique would be similar to stochastic dithering where pixels are modified to increase dynamic range.

Some displays can be addressed pixel-by-pixel instead of row-by-row. In these embodiments, essentially complete freedom with respect to which pixels to write to in what order is provided. In some such embodiments, all the white pixels in a column can be written to, and then all the black. This could be continued through the set of columns, producing one column transition per frame. In this embodiment, the rows become the high frequency modulated input and row transitions will dominate the power consumption. In this case, columns could be written to in order of whiteness to reduce the row capacitance as the display is written.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A method of writing a display image to a display having an array of pixels, the method comprising:

receiving, from a server and via a network, an image file comprising a plurality of rows and row-addressing order data for the plurality of rows;

deriving a row-addressing order for the plurality of rows based at least in part on the row-addressing order data in the image file, wherein the row-addressing order is at least partially non-sequential following a starting location; and writing the display image to the display by addressing the plurality of rows in the array of pixels according to the row-addressing order.

2. The method of claim 1, wherein the plurality of rows are stored in a frame buffer, and wherein the row-addressing order data is derived from an attribute of one or more rows of the plurality of rows stored in the frame buffer.

3. The method of claim 2, wherein the display is a bi-stable display comprising an array of interferometric modulator pixels, said pixels having an actuated state and an un-actuated state.

4. The method of claim 3, wherein one or more row attributes for the one or more rows is derived from a count of actuated pixels and a count of un-actuated pixels in that row.

5. The method of claim 3, wherein one or more row attributes for the one or more rows is derived from a ratio of actuated pixels to un-actuated pixels in a sub-row of the row.

6. The method of claim 2, further comprising prior to creating the display image on the display, sorting the one or more attributes into a numerical order.

7. The method of claim 6, wherein creating the display image on the display comprises addressing the rows in the display according to the numerical order.

8. A computer-implemented method of determining a row-addressing order for an image comprising:

determining one or more row attributes for a plurality of rows of data in the image;

determining, based on one or more row attributes, the row-addressing order for the plurality of rows, wherein the row-addressing order is at least partially non-sequential following a starting location; and embedding the row-addressing order in an image file comprising the plurality of rows of data.

9. The method of claim 8, wherein determining the row attributes comprises calculating a ratio of pixels in a first display state to pixels in a second display state for each of the one or more rows of data in the image.

10. The method of claim 9, wherein determining the row-addressing order comprises sorting the determined row attributes.

11. The method of claim 10, wherein the image is displayed on a bi-stable display comprising an array of interferometric modulator pixels, said pixels having an actuated state and an un-actuated state.

12. A method of displaying an image on a display comprising:

receiving, from a server and via a network, an image data file, the image data file including a row-addressing order for a plurality of rows, wherein the row-addressing order is at least partially non-sequential following a starting location; and creating a display image on the display by addressing the plurality of rows on the display according to the row-addressing order.

13. The method of claim 12, wherein the row-addressing order is stored in control data of the image data file.

14. The method of claim 13, wherein the control data of the image data file comprises a header of the image data file.

15. A display apparatus comprising:

a memory storing an image file, the image file comprising a plurality of rows and row-addressing order data for the plurality of rows;

a processor configured to receive, from a server and via a network, said image file and determine a row-addressing order for the plurality of rows based on the row-addressing order data, wherein the row-addressing order is at least partially non-sequential following a starting location; and a controller configured to present the plurality of rows to a display on a row-by-row basis according to the determined row-addressing order for the plurality of rows.

16. The display apparatus of claim 15, wherein the memory is a frame buffer.

17. The display apparatus of claim 15, wherein the row-addressing order is based at least in part on a number of released pixels in the plurality of rows.

18. The display apparatus of claim 15, wherein the row-addressing order is based at least in part on a first value for a first part of a row in the image file and a second value for a second part of the row in the image file.

19. The display apparatus of claim 18, wherein the first part of the row is a left half of the row, and the second part of the row is a right half of the row.

20. The display apparatus as recited in claim 15, further comprising a driver circuit configured to send at least one signal to said display.

21. The apparatus as recited in claim 20, wherein the controller is further configured to send at least a portion of said plurality of rows to said driver circuit.

22. The apparatus as recited in claim 15, further comprising an image source module configured to send said plurality of rows to said processor.

23. The apparatus as recited in claim 22, wherein said image source module comprises at least one of a receiver, transceiver, and transmitter.

24. The apparatus as recited in claim 15, further comprising an input device configured to receive input data and to communicate said input data to said processor.

25. A display apparatus comprising:

means for receiving, from a server and via a network, an image file, the image file comprising a plurality of rows and row-addressing order data for the plurality of rows;

means for deriving a row-addressing order for the plurality of rows based at least in part on the row-addressing order data in the image file, wherein the row-addressing order is at least partially non-sequential following a starting location; and means for writing a display image to a display by addressing the plurality of rows in an array of pixels in accordance with the row-addressing order.

26. The display apparatus of claim 25, wherein the means for receiving the image file comprises a network interface.

27. The display apparatus of claim 25, wherein the means for deriving a row-addressing order comprises a system processor.

28. The display apparatus of claim 25, wherein the means for deriving a row-addressing order further comprises a driver controller.

29. The display apparatus of claim 25, wherein the means for writing a display image to the display comprises an array driver.

30. A system for displaying data on an array of interferometric modulators comprising:

a server configured to calculate an addressing order for a plurality of rows, and to store the calculated addressing order in control data associated with an image data file, wherein the addressing order is at least partially non-sequential following a starting location; and a client device comprising a display and configured to receive, from the server, via a network, the plurality of rows and the calculated addressing order from the server, and to display the plurality of rows on the array by addressing the plurality of rows in the array according to the addressing order.

31. The system of claim 30, wherein the addressing order is a row-addressing order.

32. The system of claim 30, wherein the addressing order is a pixel-addressing order.

33. The system of claim 30, wherein the server is further configured to embed the calculated addressing order in the image data file.

34. The system of claim 33, wherein the calculated addressing order is embedded in a header for the image data file.

35. The system of claim 33, wherein the calculated addressing order is embedded in a body of the image data file.

36. The system of claim 30, wherein the server is a headend system in a telecommunications network.

* * * * *

UNITED STATES PATENT AND TRADEMARK OFFICE

CERTIFICATE OF CORRECTION

PATENT NO. : 8,049,713 B2
APPLICATION NO. : 11/409677
DATED : November 1, 2011
INVENTOR(S) : Jeffrey Brian Sampsell et al.

It is certified that error appears in the above-identified patent and that said Letters Patent is hereby corrected as shown below:

At Column 1, Line 9, change “and or” to --and/or--.

At Column 7, Line 45, change “ore” to --or--.

Signed and Sealed this
Eighth Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,049,713 B2
APPLICATION NO. : 11/409677
DATED : November 1, 2011
INVENTOR(S) : Jeffrey Brian Sampsell et al.

It is certified that error appears in the above-identified patent and that said Letters Patent is hereby corrected as shown below:

Title Page 1 (Item 75) (Inventor:), Line 3, add --Clarence Chui, San Mateo, CA (US)--.

Signed and Sealed this
Twenty-ninth Day of May, 2012

David J. Kappos

David J. Kappos
*Director of the United States Patent and Trademark Office*